US012139359B1

(12) United States Patent
Hund et al.

(10) Patent No.: US 12,139,359 B1
(45) Date of Patent: Nov. 12, 2024

(54) FIN BELT DUMP GATE SYSTEM AND METHOD

(71) Applicant: HALLMARK CARDS, INCORPORATED, Kansas City, MO (US)

(72) Inventors: Huston Perry Hund, Meriden, KS (US); Douglas V. Henderson, Topeka, KS (US); Glen Orrin Coats, Allen, KS (US)

(73) Assignee: HALLMARK CARDS, INCORPORATED, Kansas City, MO (US)

( * ) Notice: Subject to any disclaimer, the term of this patent is extended or adjusted under 35 U.S.C. 154(b) by 0 days.

(21) Appl. No.: 18/653,023

(22) Filed: May 2, 2024

(51) Int. Cl.
*B65H 29/34* (2006.01)
*B65H 20/06* (2006.01)
*B65H 29/14* (2006.01)

(52) U.S. Cl.
CPC ..... *B65H 29/34* (2013.01); *B65H 20/06* (2013.01); *B65H 29/145* (2013.01); *B65H 2801/81* (2013.01)

(58) Field of Classification Search
CPC ..... B65H 29/36; B65H 29/38; B65H 29/44; B65H 2404/2321; B65H 2404/3111; B65H 29/34; B65H 2801/81
USPC ..... 414/331.04; 198/347.1, 607; 271/191, 271/192
See application file for complete search history.

(56) References Cited

U.S. PATENT DOCUMENTS

2008/0267761 A1* 10/2008 Ward ..... B65H 31/28 414/788.9

OTHER PUBLICATIONS

Photographs of an example of a "Bomb bay dump gate". This item was in public use or on sale prior to May 2, 2024. (3 pgs).
Website, MFT Automation, "Rotary Batch Dropper", 2003. This item was in public use or on sale prior to May 2, 2024. (5 pgs).
Website, Longford International, "B855 High Speed Batch Counter", 2013. This item was in public use or on sale prior to May 2, 2024. (1pg).
Website, MFT Automation, "Linear Batch Dropper", 2023. This item was in public use or on sale prior to May 2, 2024. (6 pgs).

* cited by examiner

*Primary Examiner* — Jeremy R Severson
(74) *Attorney, Agent, or Firm* — STINSON LLP

(57) ABSTRACT

A dump gate system having a pair of belts configured for rotation in opposite directions and spaced apart to define a gap between the belts. Fins extend outward from the belts. The fins may support an item in the gap when the belts are in a loading position. Each belt may have a tapered section extending from the top of the belt to a lower section of the belt. Each belt may taper toward the other belt in the tapered section to gradually reduce the width of a gap between the belts from the top of each belt to the lower section. The lower sections of the belts may be generally parallel to each other. A drive system may be configured to rotate the belts to move the fins from an initial loading position to a final loading position while items are fed into the gap for support by the fins.

19 Claims, 20 Drawing Sheets

FIN BELT DUMP GATE SYSTEM AND METHOD

BACKGROUND

Dump gates are commonly used to transfer items from one location to another and form stacks of the items. For example, a dump gate may be used to stack cards fed to the gate by a feeder, and then dump the stacks of cards on a conveyor or other transfer apparatus. However, conventional dump gates suffer from a number of drawbacks. For example, conventional dump gates often stack items in a manner such that the items are not generally aligned with each other, which makes it difficult to drop the items into a relatively tight space or opening. Further, many conventional dump gates are not suitable for use to stack a relatively large number of items because the height of the stack interferes with movement of the dump gate. In addition, many conventional dump gates are relatively slow in that they have a gate structure that needs to be reset, or moved back to a loading position, after dumping a stack of items. Many conventional dump gates also require guarding to prevent injury to personnel near the gates during operation.

SUMMARY

A dump gate system in accordance with one aspect of the invention described herein includes a first belt configured for rotation in a first direction, a second belt configured for rotation in a second direction that is opposite the first direction, and first and second fins extending outward from the first and second belts, respectively. The second belt is spaced apart from the first belt to present a gap between the first and second belts. Each of the first and second belts has a tapered section that extends from the top of the respective belt to a lower section of the respective belt. The lower section of each of the belts extends from the tapered section of the respective belt to the bottom of the respective belt. Each of the belts tapers toward the other of the belts in the tapered section to gradually reduce the width of the gap from the top of each of the belts to the lower section. The lower section of the first belt is generally parallel to the lower section of the second belt. The first and second fins are configured to support at least one item in the gap when the first and second fins are in a loading position. The first and second fins are configured to dump the item when the first and second belts move the first and second fins, respectively, to a dump position. The dump gate system may be configured so that as the first and second fins move to the dump position, another set of fins moves into a loading position for receiving one or more additional items. In this manner, the dump gate system may be ready to start feeding additional items more quickly than a conventional system that needs to wait for initially fed items to drop before moving the dump gates back to the loading position so that they may receive additional items.

In some embodiments, a plurality of fins extend outward from each of the first and second belts.

In some embodiments, the first and second fins are formed from a flexible material.

In some embodiments, the first belt is mounted on a first roller frame and the second belt is mounted on a second roller frame. The first and second roller frames are movable with respect to each other to adjust the width of the gap.

In some embodiments, a backstop is positioned adjacent the first and second belts. The backstop is configured to contact an edge of the item when the item is fed between the first and second belts.

In some embodiments, a guide bar is positioned in the gap. The guide bar is configured to contact a top surface of the item when the item is fed between the first and second belts.

In some embodiments, the first and second fins are configured to support a first item fed into the gap when the first and second fins are in an initial loading position. The dump gate system further includes a drive system configured to rotate the first and second belts to move the first and second fins from the initial loading position to a final loading position. The first and second fins are configured to support a plurality of additional items that are fed into the gap on top of the first item while the first and second fins move from the initial loading position to the final loading position.

A dump gate system in accordance with another aspect of the invention described herein includes a first belt configured for rotation in a first direction, a second belt configured for rotation in a second direction that is opposite the first direction, first and second fins extending outward from the first and second belts, respectively, and a drive system configured to rotate the belts. The second belt is spaced apart from the first belt to present a gap between the first and second belts. The first and second fins are configured to support a first item fed into the gap when the first and second fins are in an initial loading position. The drive system is configured to rotate the first and second belts to move the first and second fins from the initial loading position to a final loading position. The first and second fins are configured to support a plurality of additional items that are fed into the gap on top of the first item while the first and second fins move from the initial loading position to the final loading position.

In some embodiments, the dump gate system includes a feeding platform from which the first item and plurality of additional items are fed into the gap. There may be a predetermined vertical distance from the top of the first and second fins to the feeding platform when the first and second fins are in the initial loading position. As the first and second fins move from the initial loading position to the final loading position, the vertical distance from the topmost one of the first item and the plurality of additional items that are supported by the first and second fins may be substantially the same as the predetermined vertical distance.

In some embodiments, the drive system is configured to rotate the first and second belts to move the first and second fins from the final loading position to a dump position. The first and second fins are configured to dump the first item and the plurality of additional items when the first and second fins are in the dump position. The drive system may move the first and second fins from the final loading position to the dump position in response to receiving a dump signal from a conveyor system. The dump gate system may further include third and fourth fins extending outward from the first and second belts, respectively. The third and fourth fins configured to move to the initial loading position as the first and second fins move to the dump position.

Another aspect of the invention described herein includes a method of operating a dump gate system having first and second belts spaced apart from each other to present a gap between the belts, and first and second fins extending outward from the first and second belts, respectively. The method includes feeding a plurality of items into the gap so that the items are supported by the first and second fins while the first and second belts rotate in opposite directions to move the first and second fins from an initial loading position to a final loading position; and dumping the plurality of items from the first and second fins by rotating the first and second belts to move the first and second fins from the final loading position to a dump position.

In some embodiments, the plurality of items are fed from a feeding platform, and there is a predetermined vertical distance from the top of the first and second fins to the feeding platform when the first and second fins are in the initial loading position. As the first and second fins move from the initial loading position to the final loading position, the vertical distance from the topmost one of the plurality of items that are supported by the first and second fins may be substantially the same as the predetermined vertical distance.

In some embodiments, the method includes sending a dump signal from a conveyor system to a drive system before dumping the plurality of items.

In some embodiments, third and fourth fins extend outward from the first and second belts, respectively. The third and fourth fins move to the initial loading position as the first and second fins move to the dump position.

In some embodiments, each of the first and second belts includes a tapered section that extends from the top of the respective belt to a lower section of the respective belt. The lower section of each of the belts extends from the tapered section of the respective belt to the bottom of the respective belt. Each of the belts tapers toward the other of the belts in the tapered section to gradually reduce the width of the gap from the top of each of the belts to the lower section. The lower section of the first belt is generally parallel to the lower section of the second belt.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF EXEMPLARY EMBODIMENT

Figure 1:
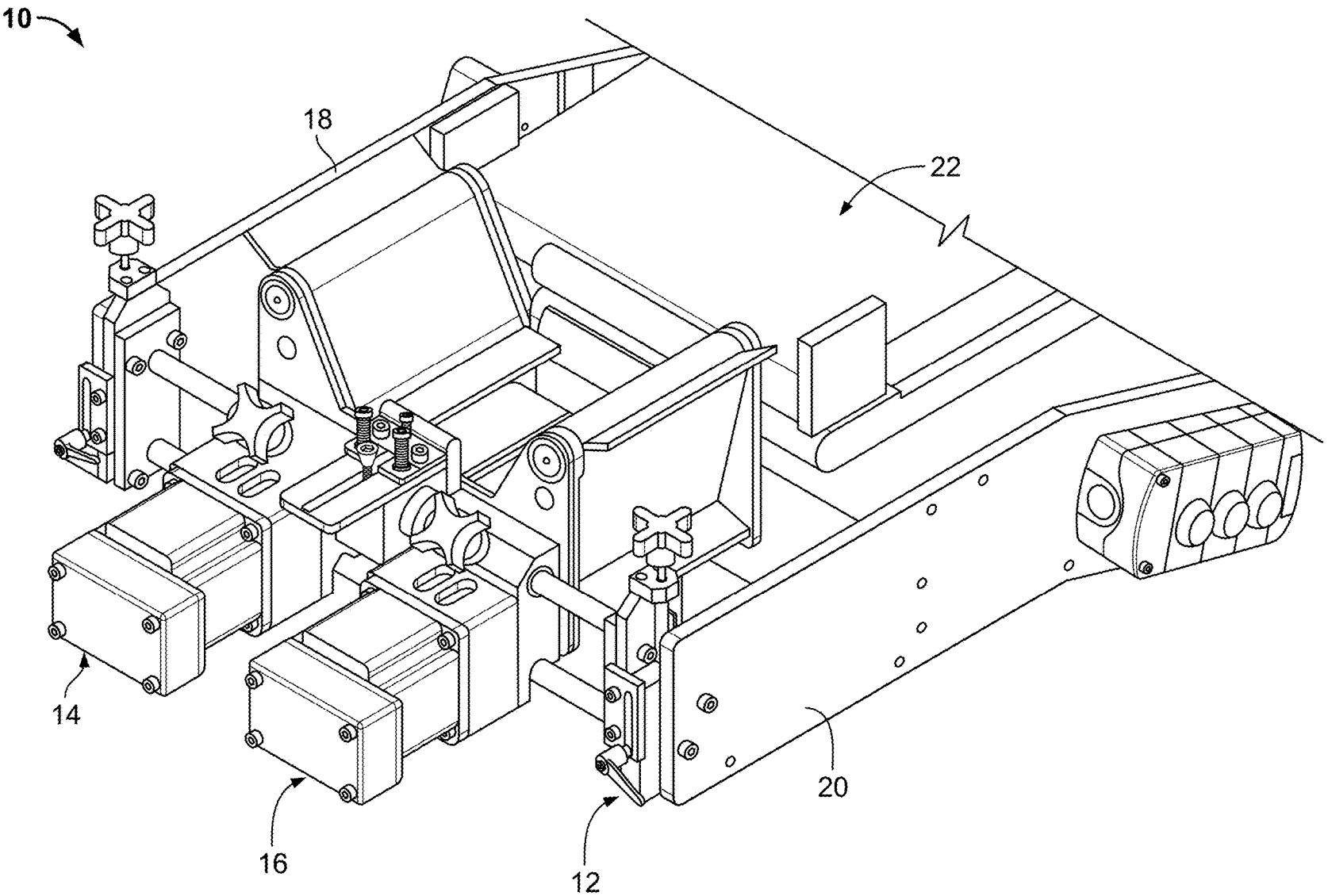
FIG. 1 is a perspective view of a dump gate system in accordance with an exemplary embodiment of the invention described herein, the dump gate system shown attached to a feeder.
Figure 2:
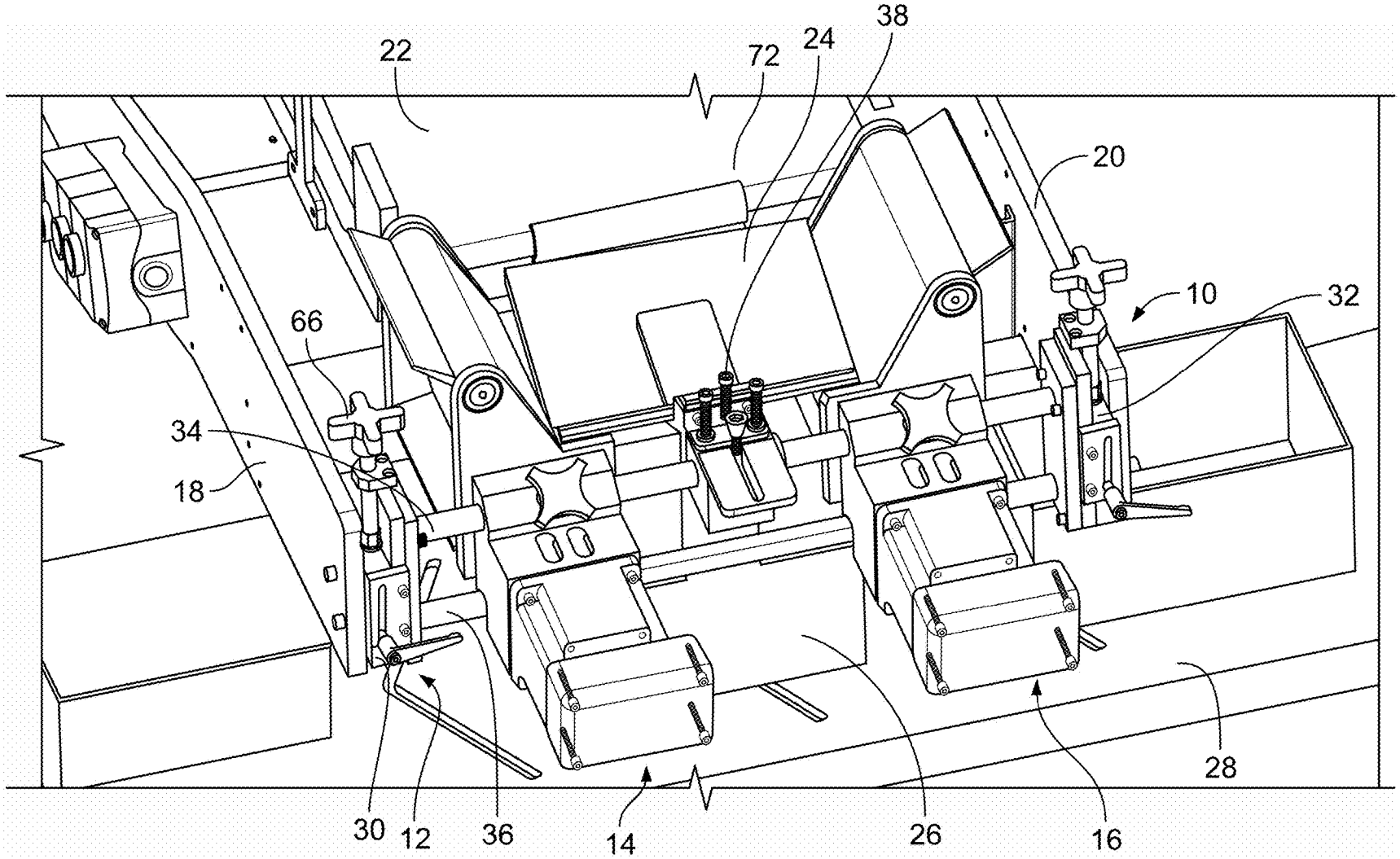
FIG. 2 is another perspective view of the dump gate system shown in FIG. 1.

A dump gate system in accordance with one exemplary embodiment of the invention described herein is identified generally as 10 in FIG. 1. The dump gate system 10 includes a feeder mounting assembly 12 and roller assemblies 14 and 16 mounted to the feeder mounting assembly 12. The feeder mounting assembly 12 is mounted to and extends between side rails 18 and 20 of a feeder 22. As shown in FIG. 2, the feeder 22 is configured to deliver items 24 to the dump gate system 10. For example, the feeder 22 may sequentially deliver items 24 at a relatively fast speed to the dump gate system 10. The items 24 delivered by the feeder 22 may be generally planar items, such as cards, greeting cards, sheets of paper, envelopes, or any other desired item. The feeder 22 may be any typical type of conventional feeding apparatus. As described in more detail below, the dump gate system 10 is configured to receive the items 24 from the feeder 22 and dump a predetermined amount of the items into boxes 26 passing on a conveyor system 28 located beneath the dump gate system 10.

Referring again to FIG. 2, the feeder mounting assembly 12 includes rail mounts 30 and 32 mounted to the side rails 18 and 20, respectively, and frame rails 34 and 36 extending between the rail mounts 30 and 32. An item guide assembly 38 is also shown in FIG. 2 positioned between the roller assemblies 14 and 16 and mounted to the frame rail 34. As described in more detail below, the item guide assembly 38 is configured to guide items 24 fed by the feeder 22 into a desired position.

Figure 3B:
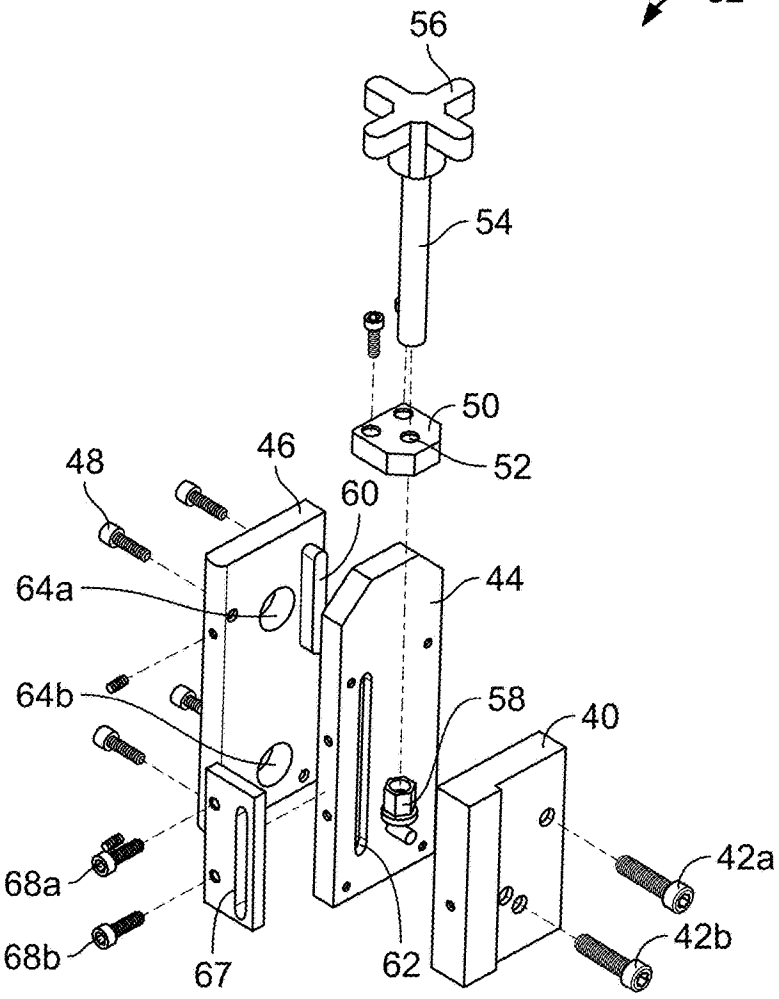
FIG. 3B is an exploded view of the rail mount shown in FIG. 3A.
Figure 3A:
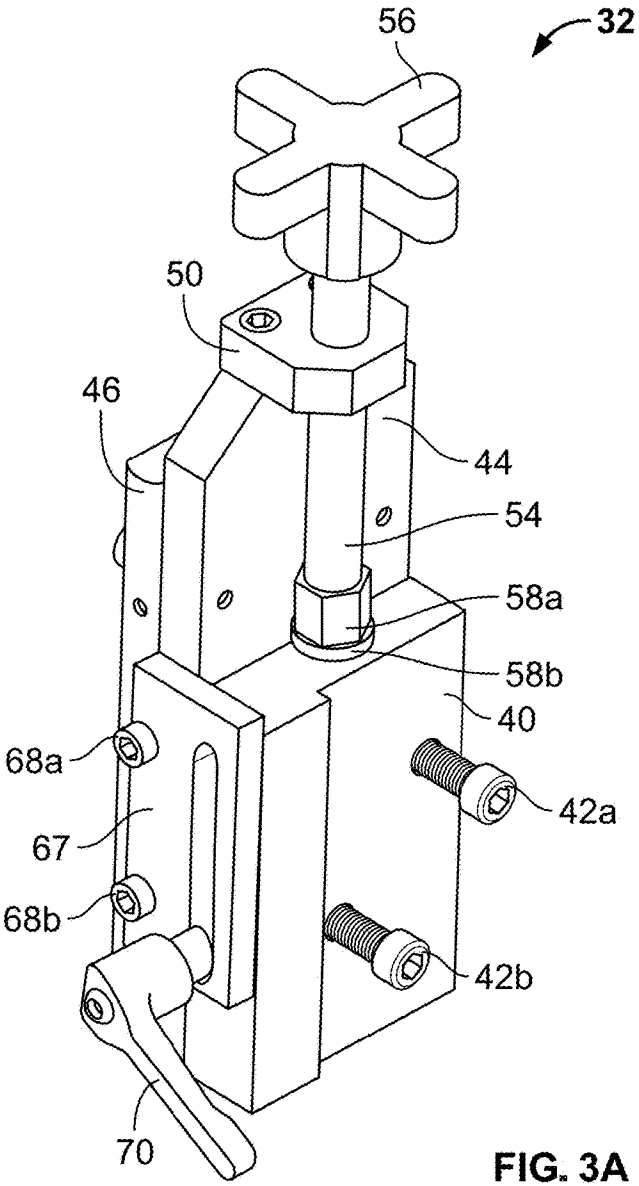
FIG. 3A is a perspective view of a rail mount of the dump gate system shown in FIG. 1.

The rail mounts 30 and 32 shown in FIG. 2 are substantially the same except for the difference that they are mirror images of each other. Thus, only the rail mount 32 is described in detail herein with reference to FIGS. 3A and 3B. The rail mount 32 includes a first mount plate 40 fixedly mounted to side rail 20 (FIG. 2) with screws 42*a-b*. Second and third mount plates 44 and 46 are fixedly mounted together with a plurality of screws, one of which is identified in FIG. 3B as 48. A plate 50 mounted to the top of mount plate 44 has a threaded opening 52 that engages a threaded shaft 54. A knob 56 is mounted to one end of the shaft 54 for rotating the shaft 54, and the opposite end of the shaft 54 is threaded into engagement with a swivel nut 58. The swivel nut 58 includes an upper section 58*a* that engages the shaft 54 and a lower section 58*b* that is mounted to the top of the first mount plate 40. The upper section 58*a* is rotatable with respect to the lower section 58*b*. As the threaded shaft 54 rotates, the second and third mount plates 44 and 46 move vertically with respect to the first mount plate 40 and the side rail 20 (FIG. 2). A key 60 is positioned in an elongated slot 62 of the second mount plate 44 and a slot (not shown) of the first mount plate 40 to maintain the respective lateral positioning of the first mount plate 40 and second mount plate 44. The elongated slot 62 is longer than the key 60 to allow the first and second mount plates 40 and 44 to move vertically with respect to each other.

Vertically spaced openings 64*a-b* in the third mount plate 46 receive ends of the rails 34 and 36 (FIG. 2), respectively. The rails 34 and 36 are also received by vertically spaced openings of the rail mount 30 shown in FIG. 2 to mount the rails 34 and 36 between the rail mounts 30 and 32. The rails 34 and 36 are adjustable vertically with respect to the side rails 18 and 20 via rotation of the knob 56 described above and rotation of the knob 66 (FIG. 2) of the rail mount 30. A plate 67 is mounted to the second mount plate 44 with fasteners 68*a-b*. A handle 70 has a threaded stud that extends through the plate 67 and can be tightened against an edge of the first mount plate 40 to fix the vertical position of the second mount plate 44 with respect to the first mount plate 40.

Figure 4A:
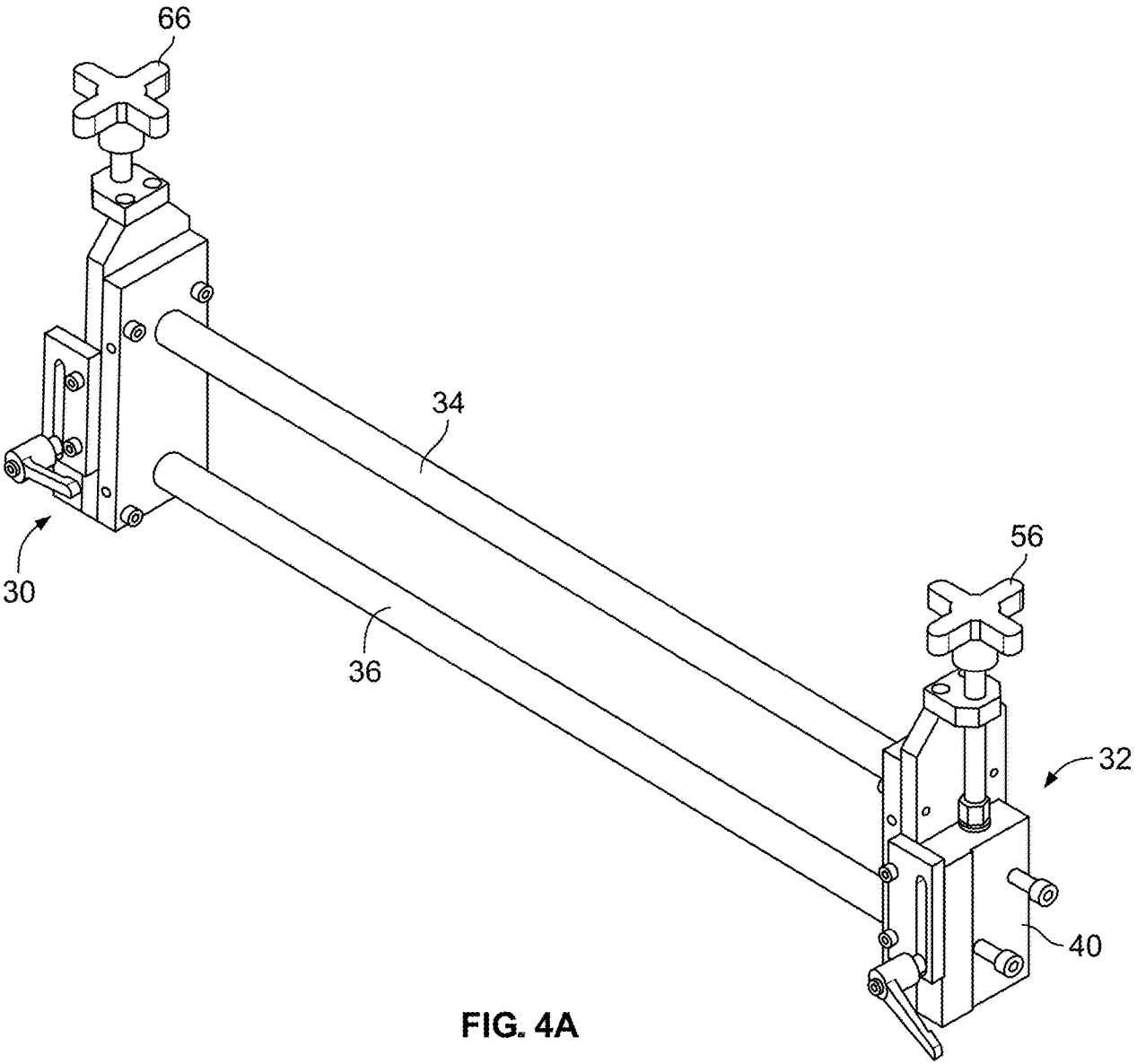
FIGS. 4A and 4B show upper and lower positions, respectively, of the rail mounts of the dump gate system shown in FIG. 1.
Figure 4B:
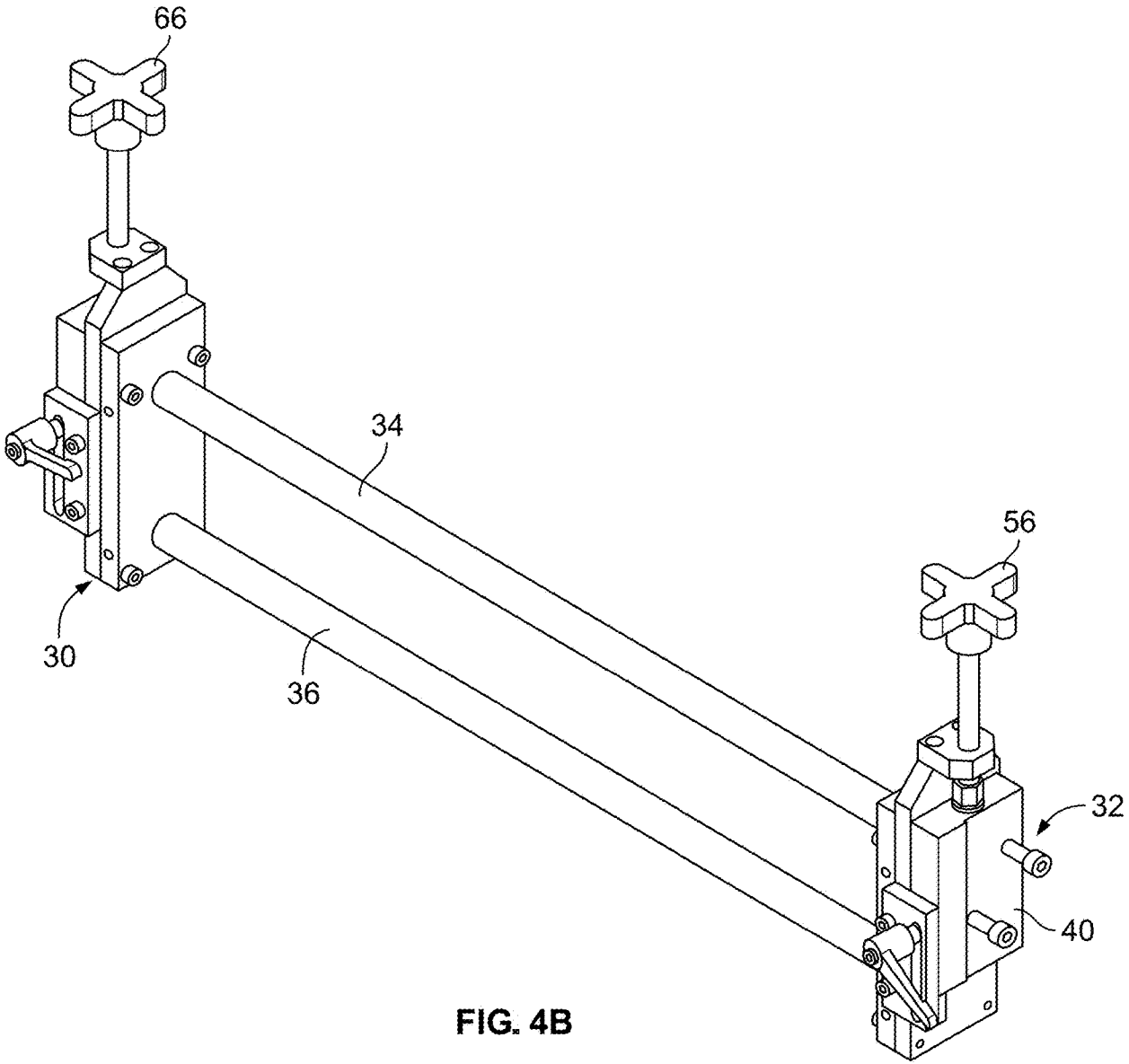

FIGS. 4A and 4B show two different vertically adjusted positions of the rail mounts 30 and 32. FIG. 4A shows the rail mounts 30 and 32 in an upper position, in which the rails 34 and 36 are vertically positioned in their uppermost position relative to the first mount plate 40 and side rails 18 and 20 (FIG. 2). FIG. 4B shows the rail mounts 30 and 32 in a lower position, in which the rails 34 and 36 are vertically positioned in their lowermost position relative to the first mount plate 40 and side rails 18 and 20. Rotation of the knobs 56 and 66 in a counterclockwise direction (as viewed when looking down at the tops of the knobs) moves the rails 34 and 36 from the upper position shown in FIG. 4A to the lower position shown in FIG. 4B, whereas rotation of the knobs 56 and 66 in a clockwise direction moves the rails 34 and 36 from the lower position to the upper position. The rails 34 and 36 may be adjusted to any position between the lower and upper positions shown in FIGS. 4A and 4B. Since the roller assemblies 14 and 16 and item guide assembly 38 are mounted to the rails 34 and 36, as shown in FIG. 2 and described in more detail below, adjustment of the rail mounts 30 and 32 as described above, adjusts the vertical position of the roller assemblies 14 and 16 and item guide assembly 38 with respect to the feeder 22, and more specifically with respect to a feeding platform 72 (FIG. 2) of the feeder 22 from which items are fed from the feeder 22 to the roller assemblies 14 and 16.

Figure 5:
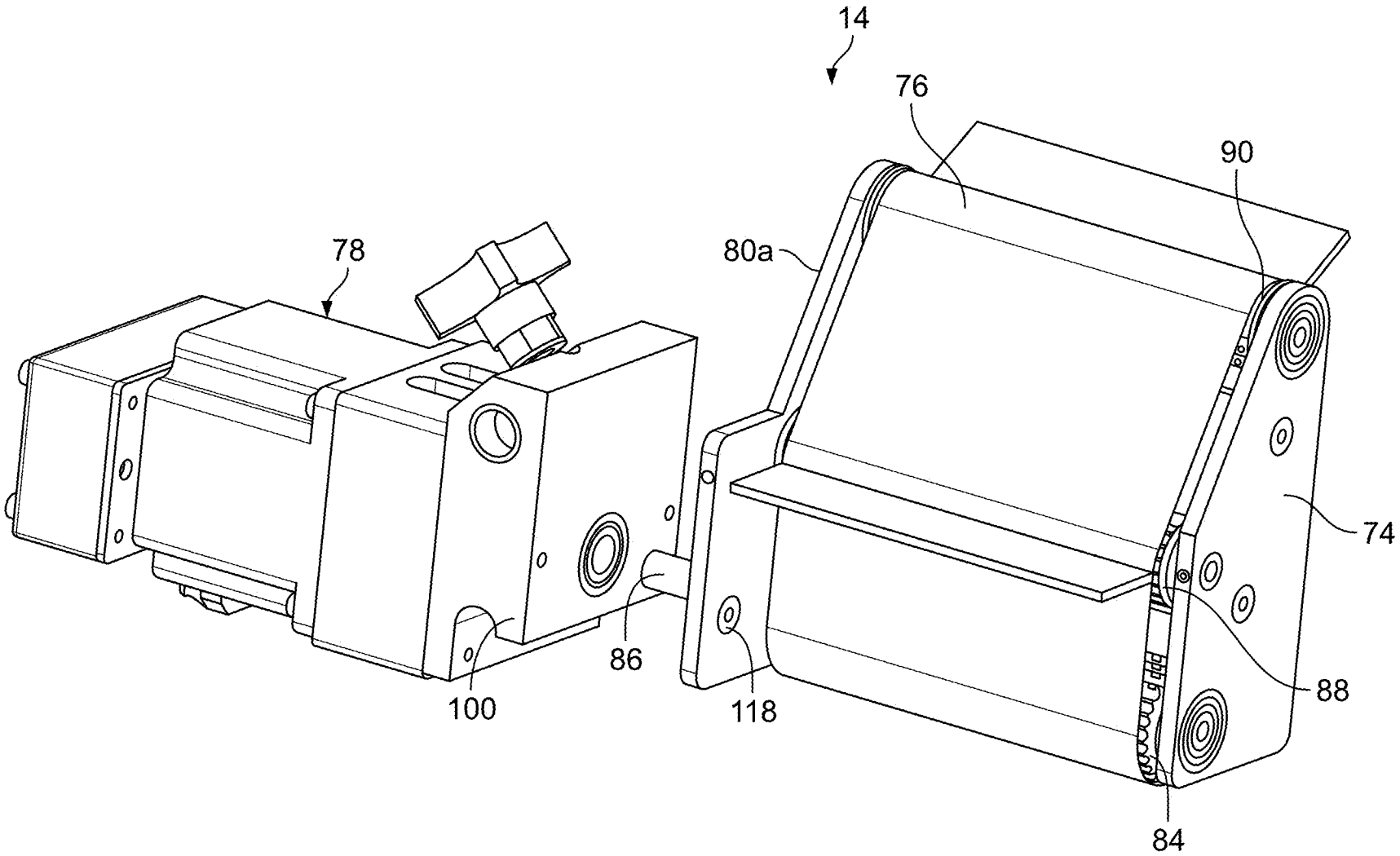
FIG. 5 shows a perspective view of a roller assembly of the dump gate system shown in FIG. 1.
Figure 6:
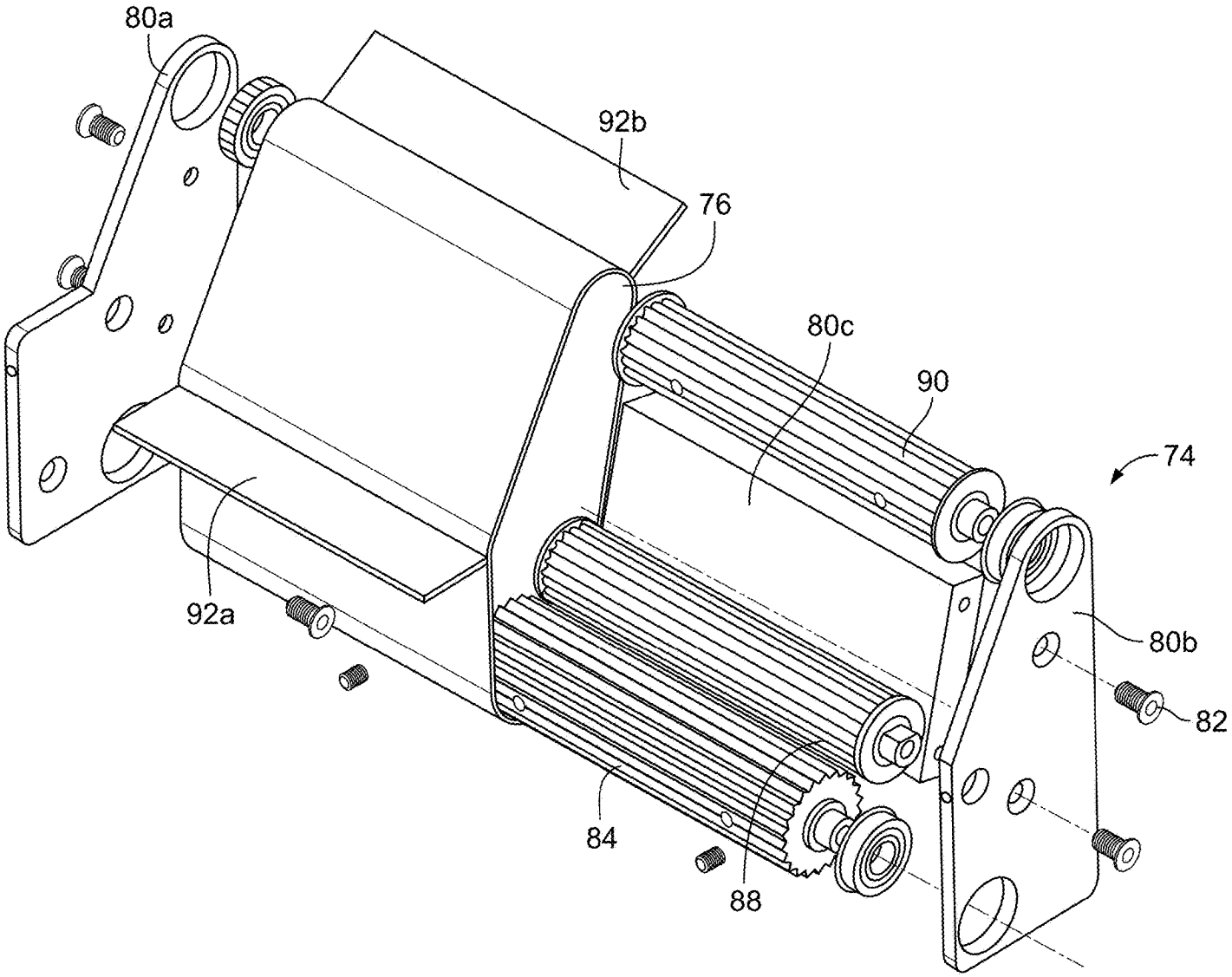
FIG. 6 shows an exploded view of a portion of the roller assembly shown in FIG. 5.

The roller assemblies 14 and 16 are substantially the same except as described below. Accordingly, only roller assembly 14 is described in detail herein with respect to FIGS. 5-7. The roller assembly 14 includes a roller frame 74, a belt 76 rotatably mounted to the roller frame 74, and a drive system 78 for rotating the belt 76. As shown in FIG. 6, the roller frame 74 includes end plates 80*a-b* that are each mounted to a center plate 80*c* with screws, one of which is identified as 82. A drive roller 84 is rotatably mounted to each of the end plates 80*a-b* and extends between the end plates 80*a-b*. A shaft 86 (FIG. 5) extending from the drive roller 84 engages the drive system 78 for rotating the drive roller 84 and belt 76. A pair of idler rollers 88 and 90 are also rotatably mounted to each of the end plates 80*a-b* and extend between the end plates 80*a-b*. The belt 76 extends around the rollers 84, 88, and 90, which support the belt, allow rotation of the belt, and maintain the shape of the belt as it rotates.

The drive roller 84 and idler roller 88 and generally vertically aligned and spaced vertically from each other adjacent the front and the bottom of the roller frame 74. The idler roller 90 is positioned adjacent the rear and the top of the roller frame 74. The positioning of the rollers 84, 88, and 90 defines the shape of the belt 76 as described in more detail below. Three fins (two of which are shown in FIG. 6 as 92*a-b*) extend outward from the exposed surface of the belt 76. The fins 92*a-b* extend outward generally perpendicular from the exposed surface of the belt 76, perpendicular to a linear direction of movement of the belt 76. The belt 76 and fins 92*a-b* may be formed from a flexible material, and the fins 92*a-b* may be formed integrally with the belt 76 or joined to the belt 76. Since the fins are formed from a flexible material, they may be relatively safe to work around without the need to add guarding to the dump gate system 10.

Figure 7:
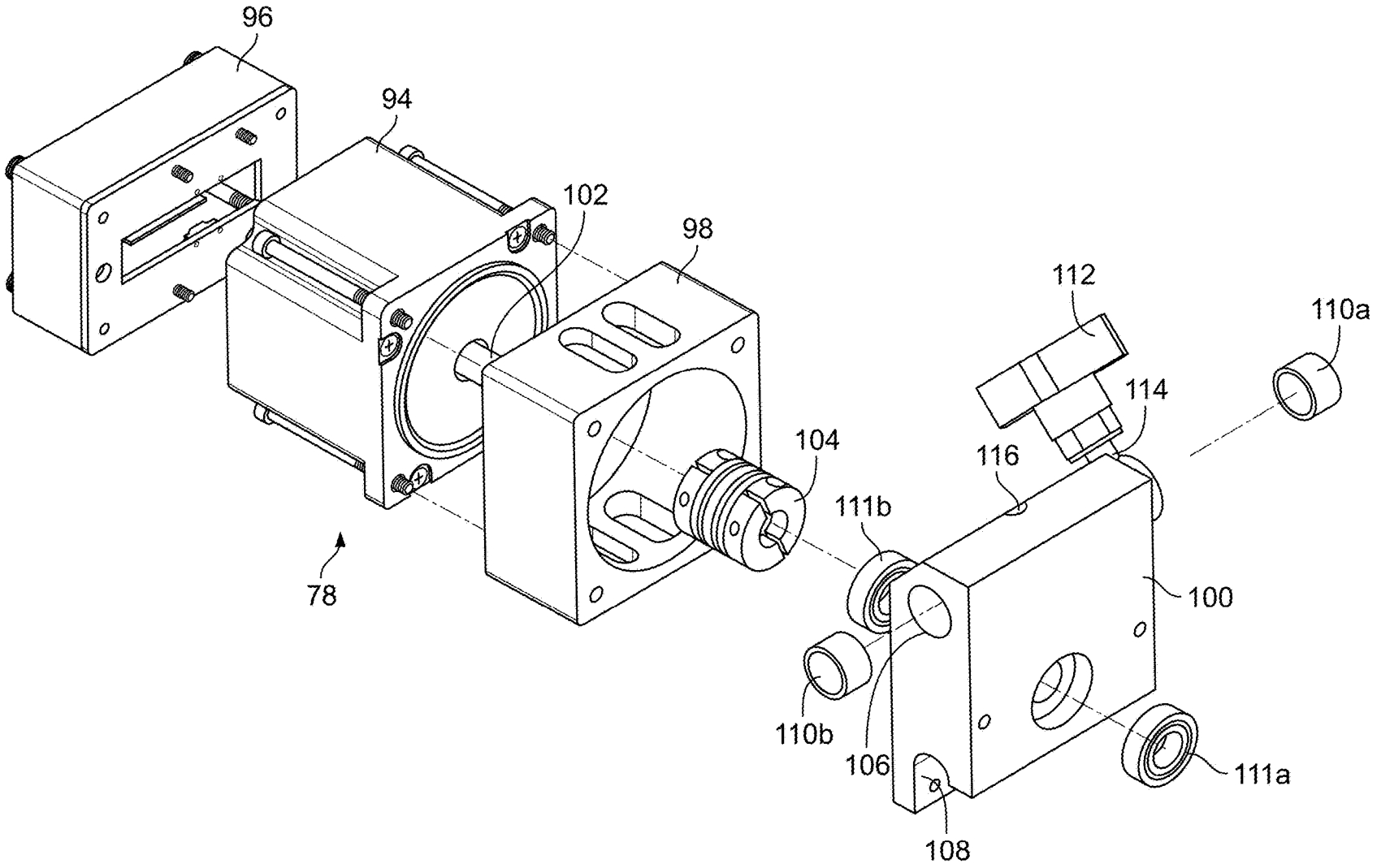
FIG. 7 shows an exploded view of a drive system of the roller assembly shown in FIG. 5.

The drive system 78 is described in more detail with reference to FIG. 7. The drive system 78 includes a motor 94, a sensor 96 attached to one side of the motor 94, a spacer 98 attached to an opposite side of the motor 94, and a rail mount 100 attached to the spacer 98. The motor 94 includes a shaft 102 extending outward from a housing of the motor 94. A coupler 104 is attached to the shaft 102 of the motor 94 and the shaft 86 (FIG. 5) of the drive roller 84 to allow the motor 94 to rotate the drive roller 84 and belt 76. The sensor 96 may be a photoelectric sensor for sensing a position of the motor 94, which enables tracking of the position of the belt 76 and fins 92*a-b* of the belt. The sensor 96 may be any other type of sensor configured to track the position of the motor 94. Alternatively, the motor 94 may have a built-in sensor configured to track the position of the shaft 102.

The rail mount 100 includes a through hole 106 adjacent its top and a slot 108 that opens to a bottom surface of the rail mount 100. The hole 106 receives the rail 34 (FIG. 2) and the slot 108 receives the rail 36 to slidingly mount the rail mount 100 to the rails 34 and 36. The rail 34 slides within bushings 110*a-b* mounted in the hole 106. Bearings 111*a-b* mounted in the rail mount 100 receive the shaft 86 (FIG. 5). A knob 112 with a threaded shaft 114 extends into a threaded opening 116 of the rail mount 100. The knob 112 may be tightened so that the threaded shaft 114 engages the rail 34 to lock the rail mount 100 to the rail 34. When the knob 112 is loosened, the rail mount 100 is slidable on the rail 34 to allow horizontal adjustment of the roller assembly 14 with respect to the feeding platform 72 (FIG. 2). Referring to FIG. 5, the end plate 80*a* of the roller frame 74 is mounted to the rail mount 100 with fasteners, one of which is shown as 118.

Figure 8A:
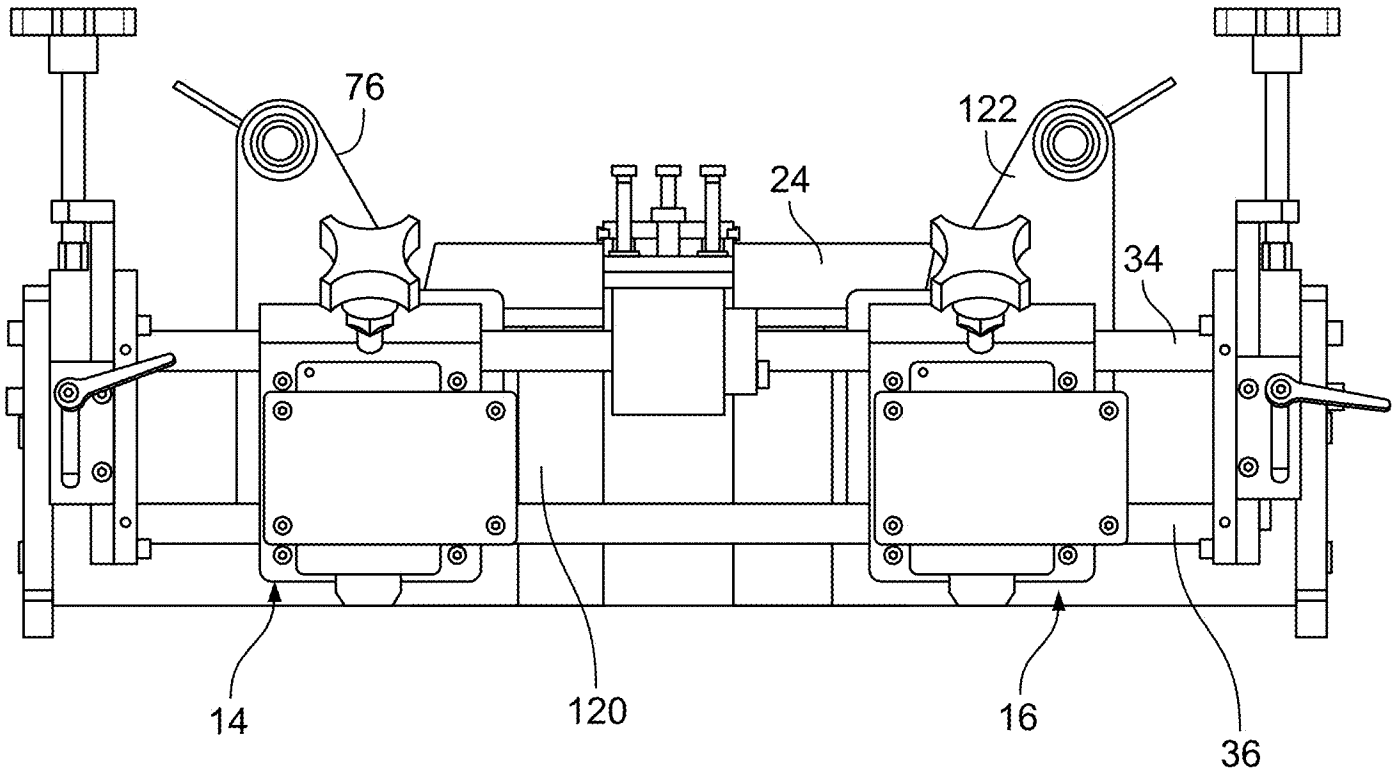
FIGS. 8A and 8B are elevational views of the dump gate system of FIG. 1 showing alternative positions of roller assemblies of the dump gate system.
Figure 8B:
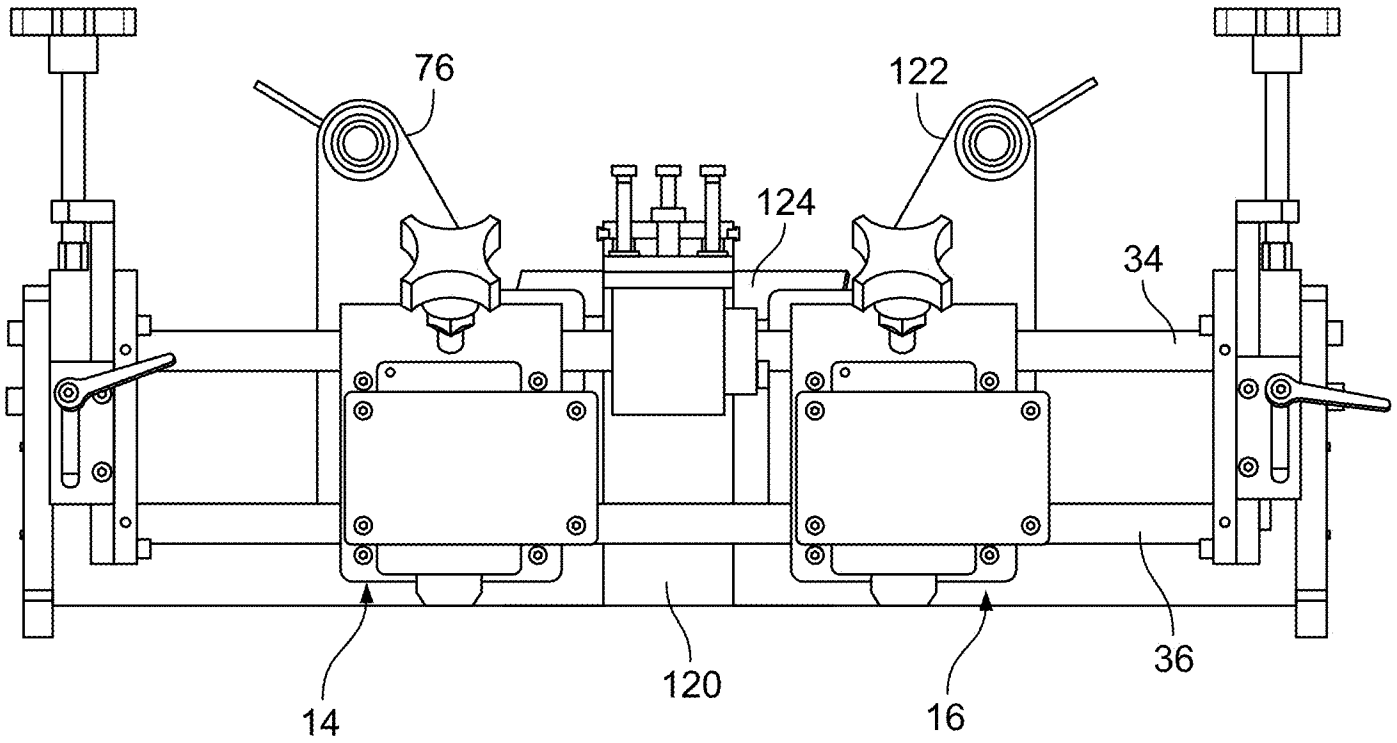
Figure 9A:
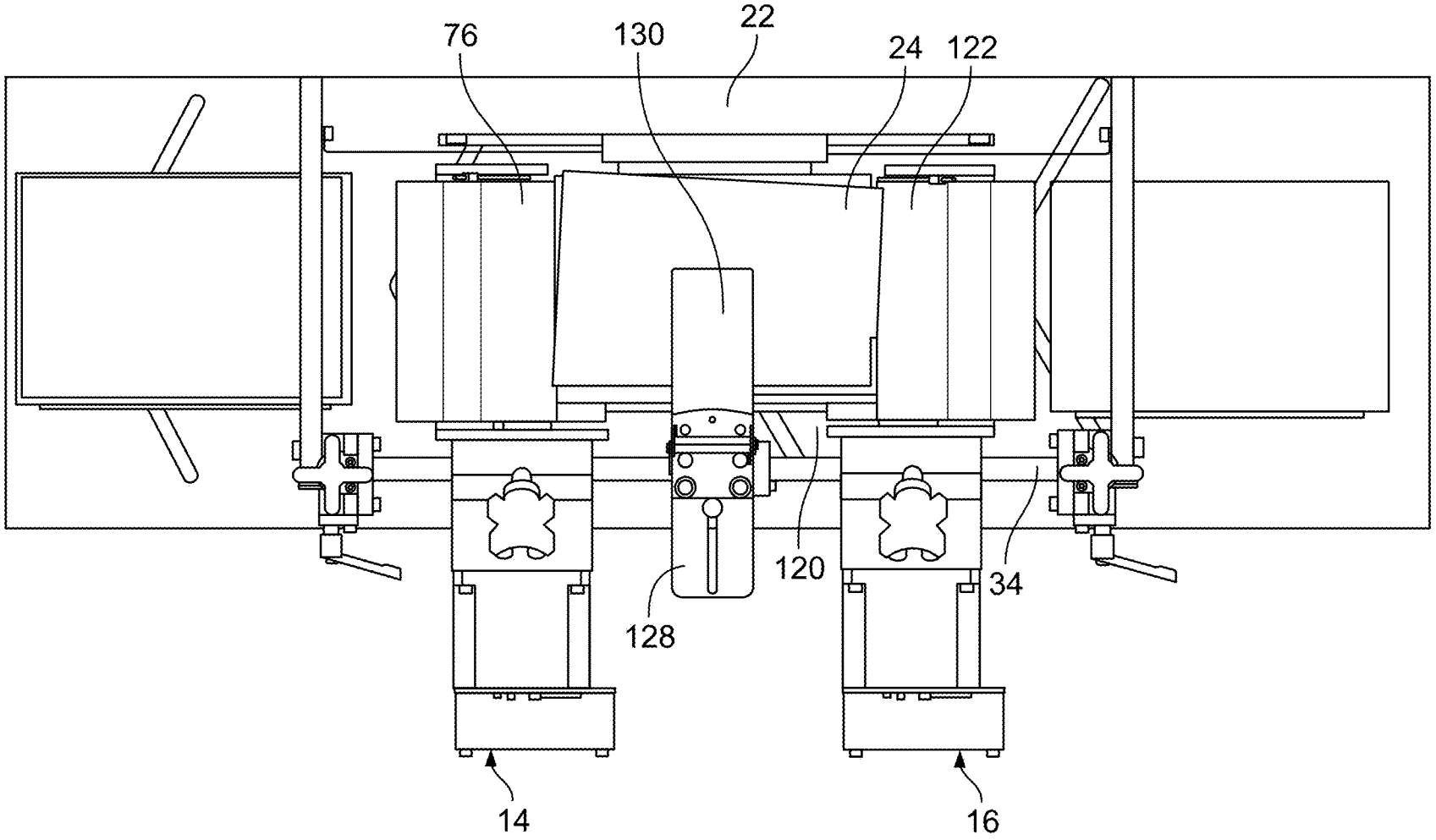
FIGS. 9A and 9B are plan views of the dump gate system of FIG. 1 showing alternative positions of the roller assemblies of the dump gate system.
Figure 9B:
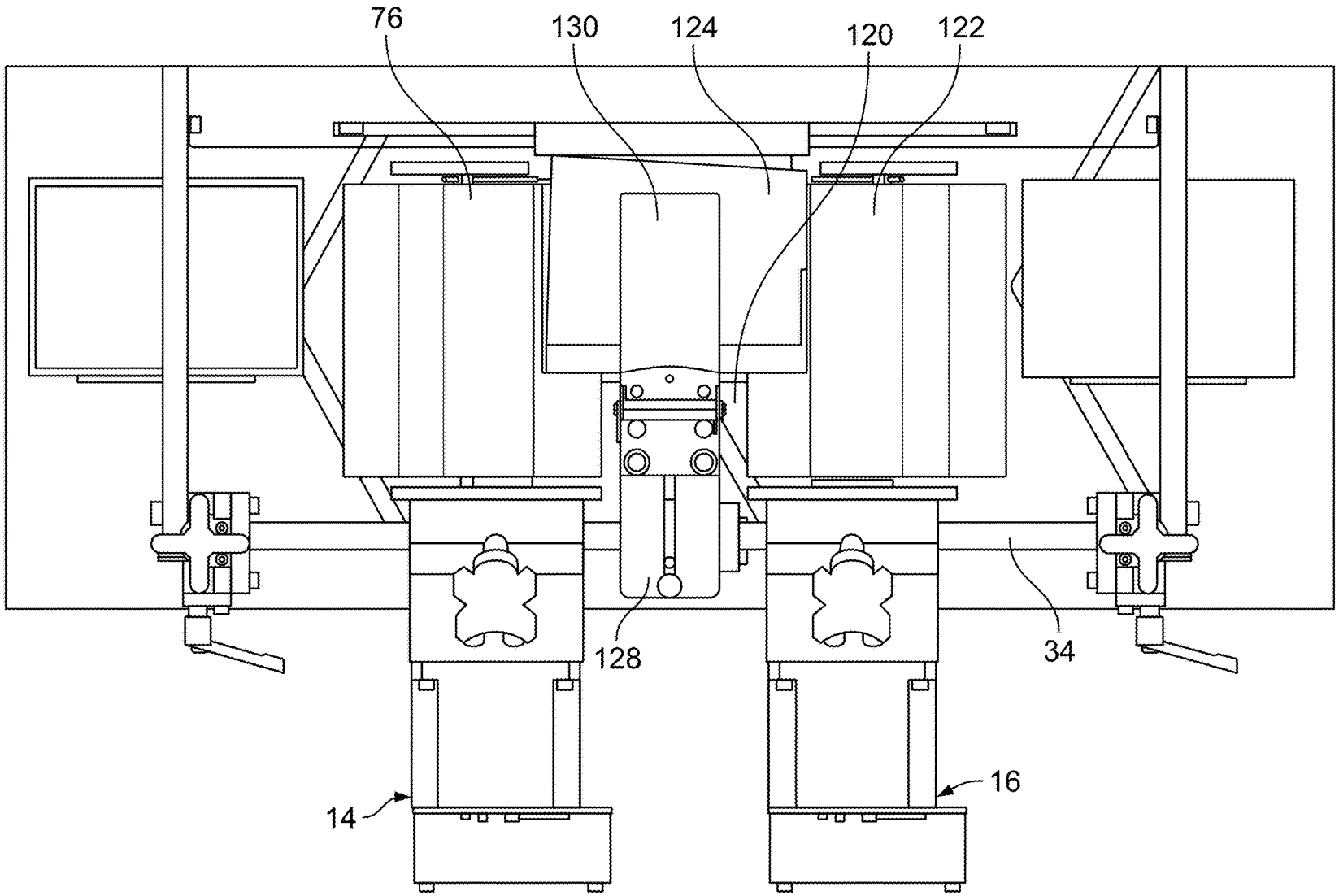

FIGS. 8A and 9A show one position of the roller assemblies 14 and 16, and FIGS. 8B and 9B show an alternative position of the roller assemblies 14 and 16. As shown in FIGS. 8A-9B, there is a gap 120 between the belt 76 of the roller assembly 14 and the belt 122 of the roller assembly 16. The width of the gap 120, or distance between the belts 76 and 122, is adjustable by horizontally sliding the roller assemblies 14 and 16 on the rails 34 and 36, as described above. FIGS. 8A and 9A show the gap 120 as being wider than the gap 120 shown in FIGS. 8B and 9B. The width of the gap 120 may be adjusted based on the width or length of the items being fed between the roller assemblies 14 and 16 by the feeder 22. FIGS. 8A and 9A show relatively long items 24, while FIGS. 8B and 9B show an alternative set of items 124 that are relatively short.

Figure 10A:
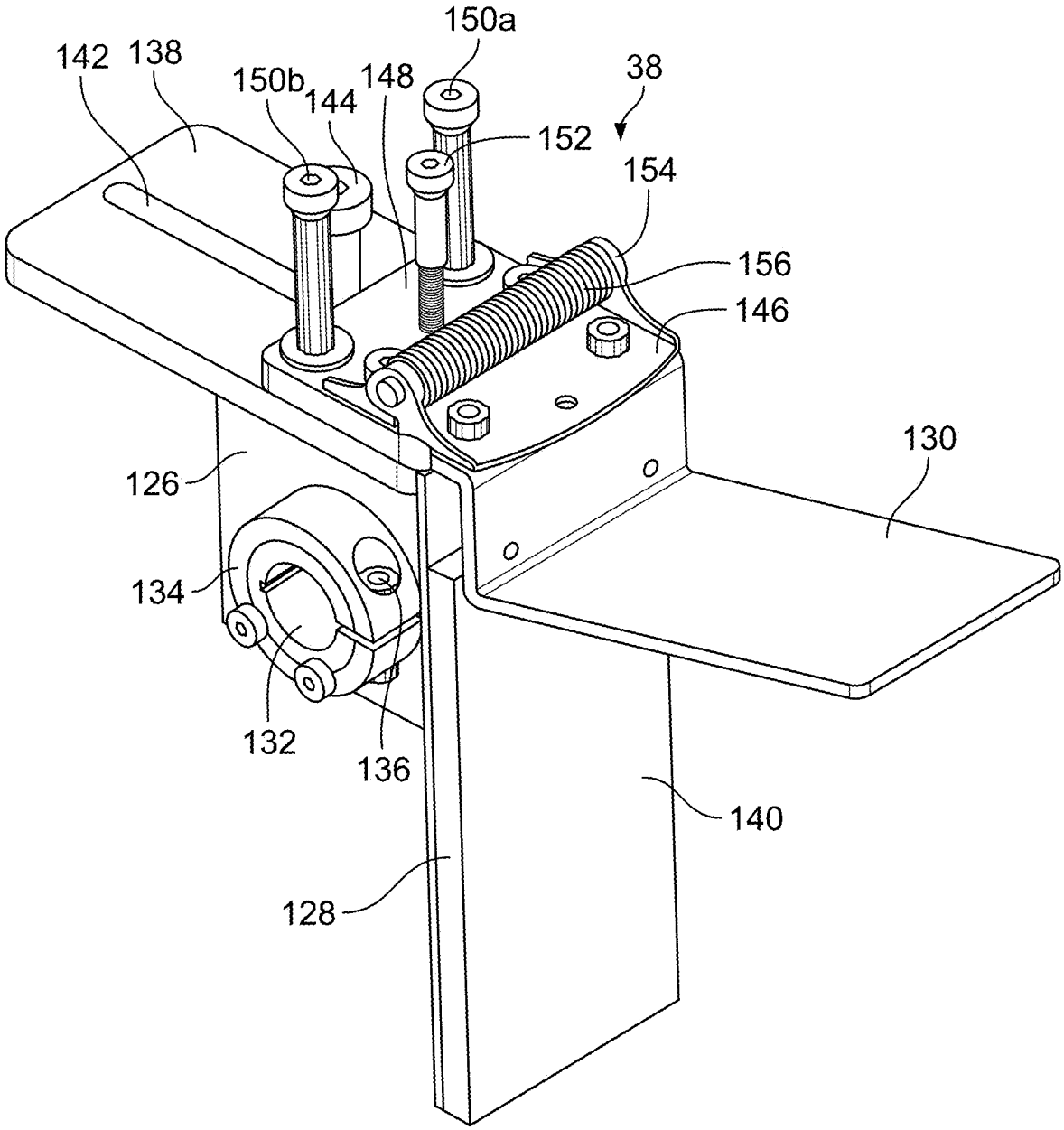
FIGS. 10A and 10B are perspective view of an item guide assembly of the dump gate system of FIG. 1 showing alternative positions of a backstop and a guide bar of the item guide assembly.
Figure 10B:
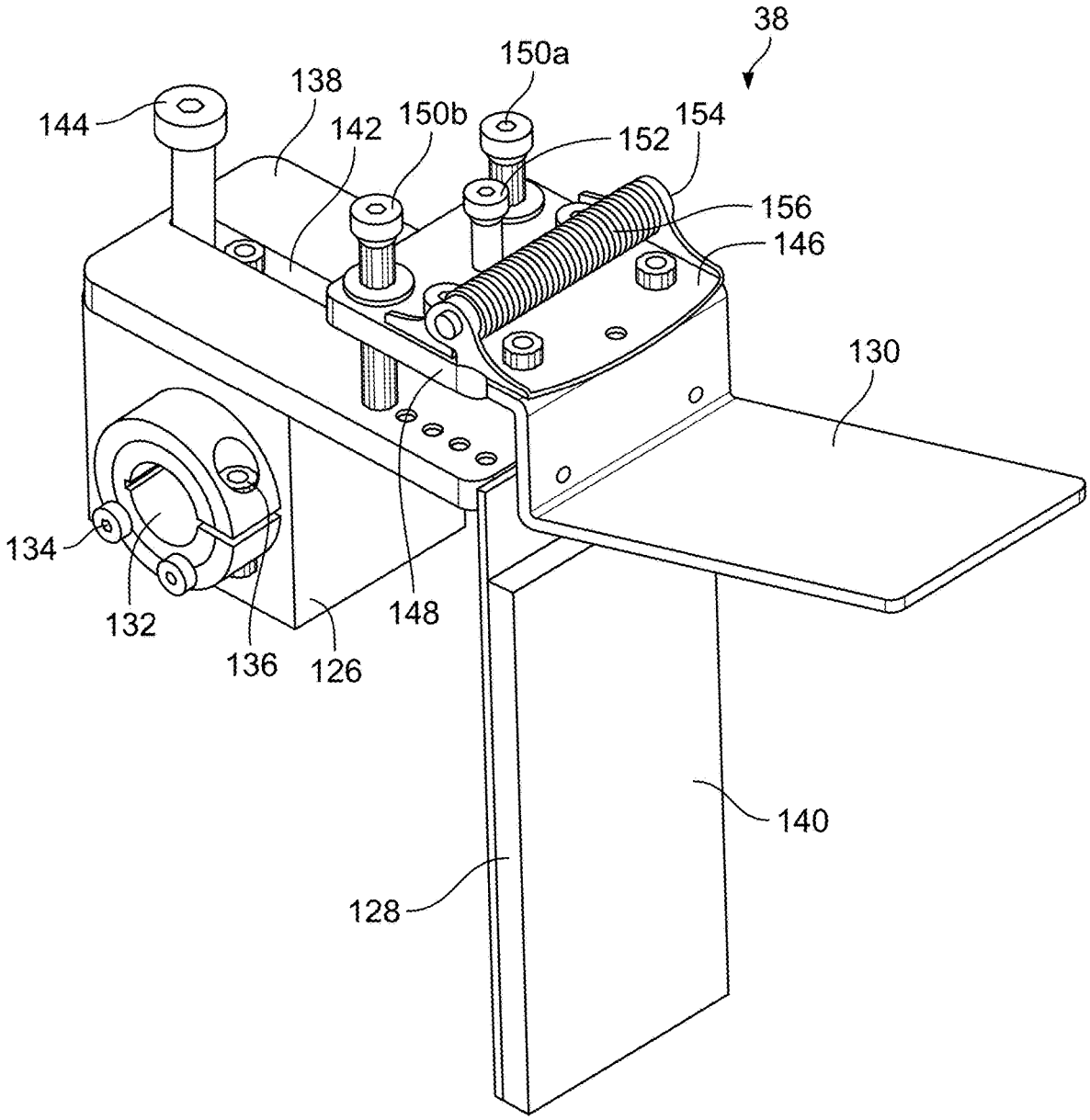

The item guide assembly 38 is shown in more detail in FIGS. 10A and 10B. The item guide assembly 38 includes a base 126, a backstop 128 adjustably mounted on the base 126, and a guide bar 130 adjustably mounted on the base 126. A hole 132 extends through the base 126 and receives the frame rail 34, as shown in FIG. 2. A collar 134 mounted to the base 126 includes an adjustable hole that receives the frame rail 34. The collar 134 includes a fastener 136 that can be tightened to clamp the collar 134 to the frame rail 34 and fix the position of the item guide assembly 38 on the frame rail 34. The fastener 136 can be loosened to adjust the position of the item guide assembly 38 on the frame rail 34.

The backstop 128 includes an upper portion 138 that slidably engages an upper surface of the base 126 and a lower portion 140 extending downward generally perpendicular from the upper portion 138. The upper portion 138 includes a slot 142. A shoulder bolt 144 is received by the slot 142 and threadably engages an opening (not shown) in the base 126. When the shoulder bolt 144 is loosened, the backstop 128 may be adjusted by sliding it with respect to the base 126 in the direction that the slot 142 extends. For example, FIG. 10A shows the backstop 128 in a first position, in which the lower portion 140 is positioned adjacent the base 126, and FIG. 10B shows the backstop 128 in a second position, in which the lower portion 140 is spaced apart from the base 126. The shoulder bolt 144 may be tightened against the upper portion 138 to fix the position of the backstop 128 relative to the base 126. As shown in FIGS. 9A and 9B, the backstop 128 is positioned adjacent the belts 76 and 122. The backstop 128 is configured to contact an edge of each of the items 24 when the items 24 are fed between the belts 76 and 122. For example, as shown in FIG. 9A, the backstop 128 contacts the leading edge of the items 24 as the items are fed between the belts 76 and 122 from the feeder 22. In this manner, the backstop 128 ensures that the items 24 remain in the intended position in the gap 120 between the belts 76 and 122 and do not travel through the gap 120 past the belts 76 and 122 when fed by the feeder 22. FIG. 9A shows the backstop 128 adjusted to the first position shown in FIG. 10A. In this position, the backstop 128 is configured so that relatively wide items 24 may be fed into the gap 120. FIG. 9B shows the backstop 128 adjusted to the second position shown in FIG. 10B. In this position, the backstop 128 is configured so that relatively narrow items 124 may be fed into the gap 120. The backstop 128 may be adjusted to any position between the first and second positions shown depending on the shape of the items being fed into the gap 120.

As shown in FIGS. 10A and 10B, the guide bar 130 is mounted to the upper portion 138 of the backstop 128 and extends outward from the backstop 128 above the lower portion 140 of the backstop 128. The guide bar 130 is mounted to a hinge 146, which is mounted to a plate 148 positioned above the upper portion 138 of the backstop 128. Two posts 150*a-b* extending upward from the upper portion 138 of the backstop 128 are received by openings in the plate 148. The plate 148 is vertically slidable on the posts 150*a-b*. A screw 152 threadably engages an opening in the plate 148. Rotation of the screw 152 vertically adjusts the position of the guide bar 130. FIG. 10A shows the guide bar 130 in a lowermost position with respect to the backstop 128, and FIG. 10B shows the guide bar 130 raised vertically from the lowermost position. The screw 152 may be rotated in a clockwise direction when viewed from above the plate 148 to raise the guide bar 130 with respect to the backstop 128, and rotated in a counterclockwise direction to lower the guide bar 130. The hinge 146 allows the guide bar 130 to pivot upward around a pin 154. A torsion spring 156 biases the guide bar 130 downward.

As shown in FIG. 9A, the guide bar 130 is positioned in the gap 120 between the belts 76 and 122. The guide bar 130 is configured to contact a top surface of the items 24 being fed into the gap 120. As the items 24 are fed into the gap 120, the items rub against the guide bar 130 and items supported on the fins of the belts 76 and 122 to dissipate a portion of the energy of the moving items. This reduces unwanted movement of the items as they are fed into position in the gap 120 and assists in maintaining proper positioning of the items for deposit in a box 26 (FIG. 2). The guide bar 130 is adjustable vertically so that it may be placed in a desired position for the type of items being fed by the feeder 22.

Figure 11:
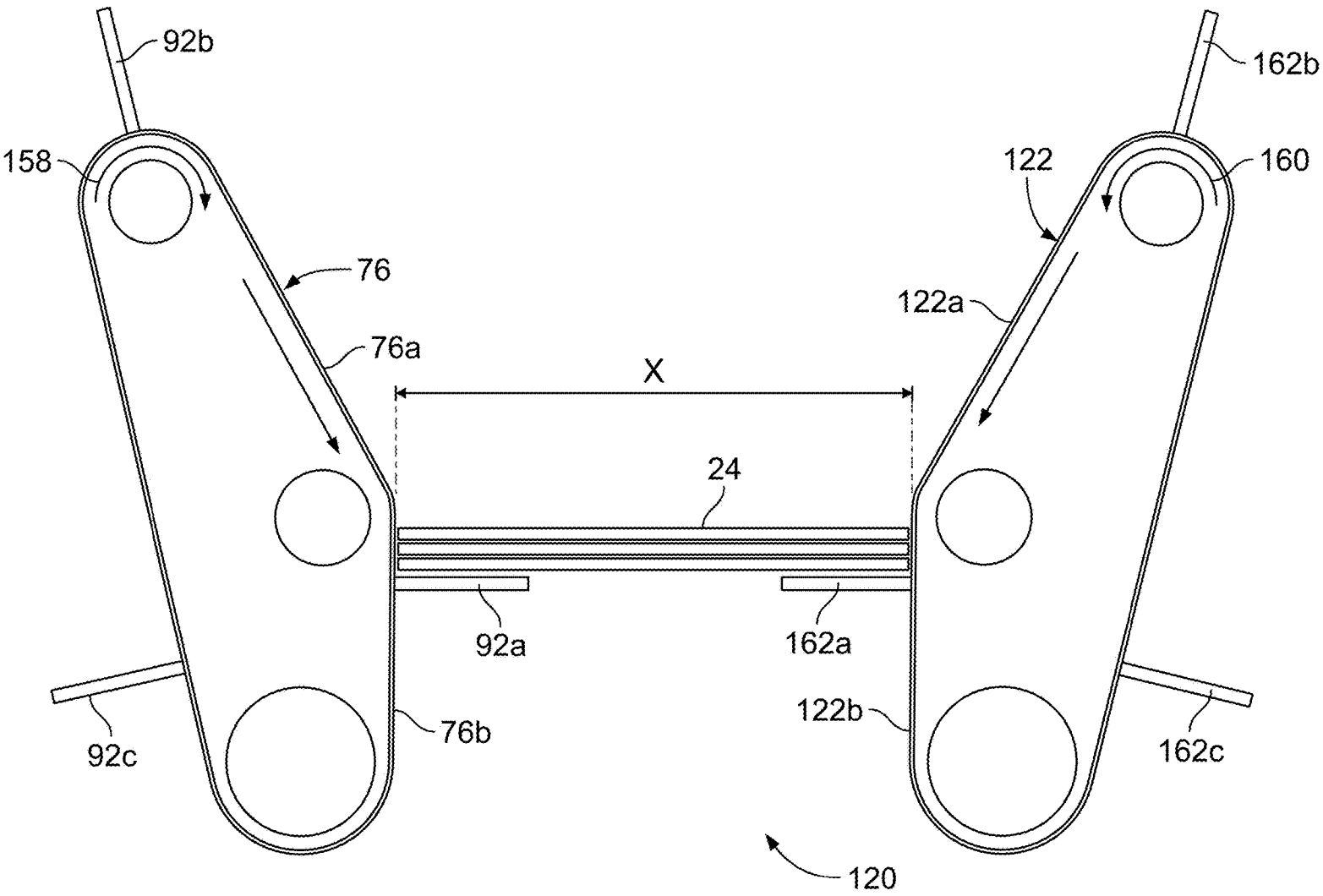
FIG. 11 is an elevational schematic view of belts of the dump gate system shown in FIG. 1.

The belts 76 and 122 are described in more detail with reference to FIG. 11. The belt 76 rotates in a first direction 158, and the belt 122 rotates in a second direction 160 that is opposite the first direction 158. The belts 76 and 122 are spaced apart from each other to form the gap 120 between the belts. Each of the belts 76 and 122 has a tapered section 76*a* and 122*a*, respectively, that extends from the top of the respective belt to a lower section 76*b* and 122*b* of the respective belt. The lower section 76*b* and 122*b* of each belt 76 and 122, respectively, extends from the tapered section 76*a* and 122*a* of the respective belt to the bottom of the respective belt. The tapered sections 76*a* and 122*a* of the belts 76 and 122 taper toward each other to gradually reduce the width of the gap 120 from the top of each of the belts 76 and 122 to the lower sections 76*b* and 122*b*. The lower sections 76*b* and 122*b* of the belts 76 and 122, respectively, are generally parallel to each other. The width of the gap 120 between the lower sections 76*b* and 122*b* is shown as X in FIG. 11. As described above, this width may be adjusted as desired based on the length or width of the items 24. As shown in FIG. 11, the width X may be adjusted to be slightly larger than the length of the items 24 so that the items fit in the gap 120 without damaging the items or impeding rotation of the belts 76 and 122, and so that the items are stacked in alignment such that they can be deposited together in a box 26 (FIG. 2).

As described above, three fins 92*a-c* extend outward from the belt 76, and three fins 162*a-c* extend outward from the belt 122. The fins 92*a-c* and 162*a-c* are spaced equidistant from each other around the belts 76 and 122, respectively. Fins 92*a* and 162*a* are configured to support the items 24 in the gap 120 when the fins 92*a* and 162*a* are in a loading position, as shown in FIG. 11. As described in more detail below, as the belts 76 and 122 rotate in the directions 158 and 160, respectively, the fins 92*a* and 162*a* move downward toward the bottom of the belts 76 and 122. As the fins 92*a* and 162*a* move around the rollers at the bottom of the belts 76 and 122 to a dump position, the items 24 are dumped into a box 26 (FIG. 2) on the conveyor system 28. Although each of the belts 76 and 122 is shown with three fins, the belts 76 and 122 may have more or less than three fins.

Figure 12:
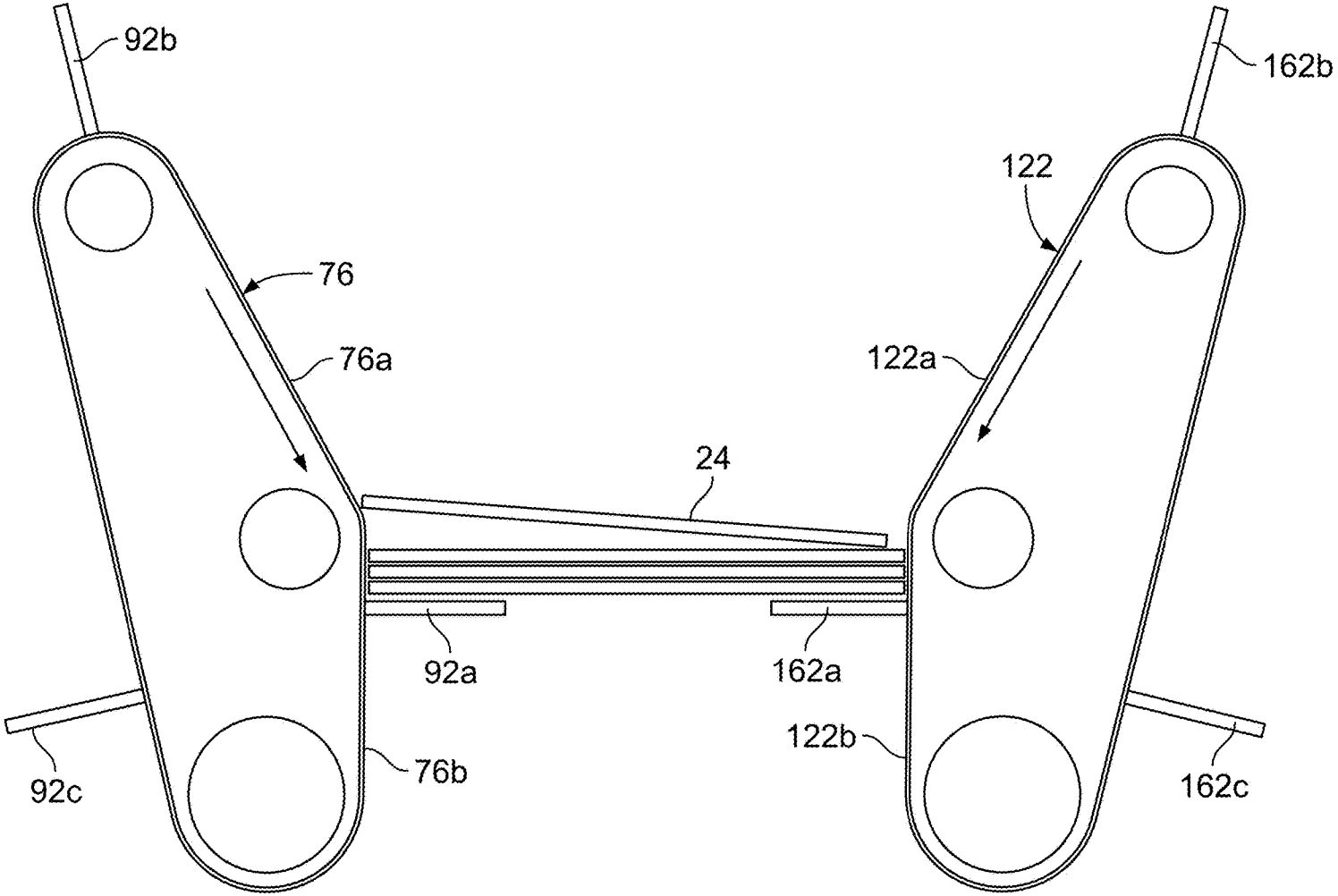
FIG. 12 is another elevational schematic view of the belts of the dump gate system shown in FIG. 1.

As shown in FIG. 12, the tapered sections 76*a* and 122*a* of the belts assist in aligning the items 24 in a stack on the fins 92*a* and 162*a*. The belts 76 and 122 may be vertically adjusted as described above so that items 24 fed by the feeder 22 (FIG. 2) enter the gap 120 between the belts 76 and 122 at just above the location where the tapered sections 76*a* and 122*a* transition to the lower sections 76*b* and 122*b*. As the items 24 enter the gap 120 at the tapered sections 76*a* and 122*a*, the tapered sections 76*a* and 122*a* gradually move the items 24 downward and into alignment with the gap between the lower sections 76*b* and 122*b*. Thus, if the feeder 22 feeds items 24 that are not in perfect horizontal alignment with the gap between the lower sections 76*b* and 122*b*, the tapered sections 76*a* and 122*a* assist in moving those items 24 into alignment with the gap between the lower sections 76*b* and 122*b* so that all of the items 24 stacked on the fins 92*a* and 162*a* are in general horizontal alignment with each other. Stacking the items 24 on the fins 92*a* and 162*a* in horizontal alignment with each other allows the items 24 to be dumped together through the opening of a box that is only slightly larger than the items.

Figure 13B:
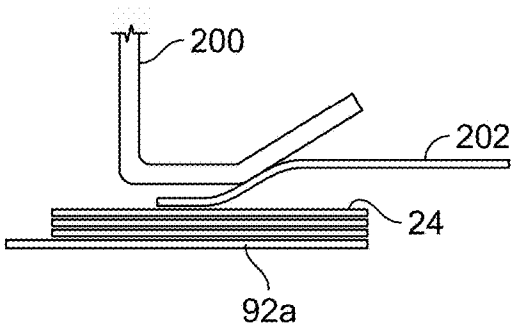
FIG. 13B is a cross-sectional view taken through the line 13B-13B of FIG. 13A.
Figure 13D:
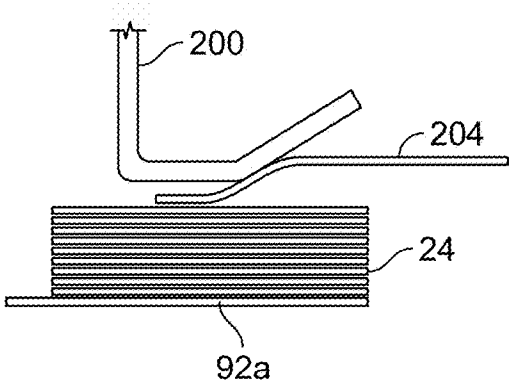
FIG. 13D is a cross-sectional view taken through the line 13D-13D of FIG. 13C.
Figure 13A:
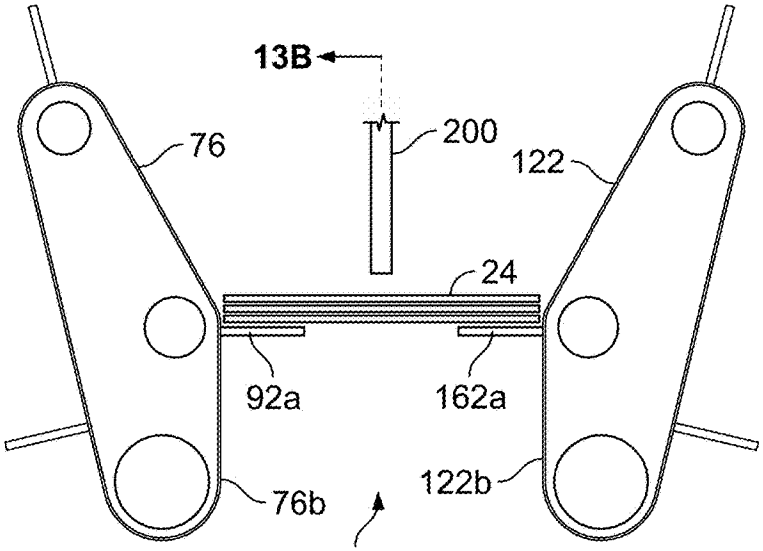
FIG. 13A is an elevational schematic view of the belts of the dump gate system of FIG. 1 showing a guide bar.

Referring to FIGS. 13A-D, an alternative embodiment of guide bar 200 is shown that operates in a similar manner as the guide bar 130 described above. The guide bar 200 is shown positioned in the gap 120 between the belts 76 and 122. FIG. 13A shows three items 24 stacked on top of the fins 92*a* and 162*a*. FIG. 13B shows an additional item 202 being fed between the belts 76 and 122. As the additional item 202 is fed between the belts 76 and 122, the top surface of the item 202 makes contact with the underside of the guide bar 200 to deflect the item 202 downward so that the bottom surface of the item 202 contacts the top of the stack of items 24 on the fins 92*a* and 162*a*. Thus, as the item 202 is fed between the belts 76 and 122, it frictionally engages both the guide bar 200 and the top of the stack of items 24. This frictional engagement dissipates a portion of the energy of the moving item 202 to prevent the item 202 from bouncing on the stack of items 24 as it is fed, which assists in aligning the item 202 on top of the stack of items 24 between the lower sections 76*b* and 122*b* of the belts 76 and 122.

Figure 13C:
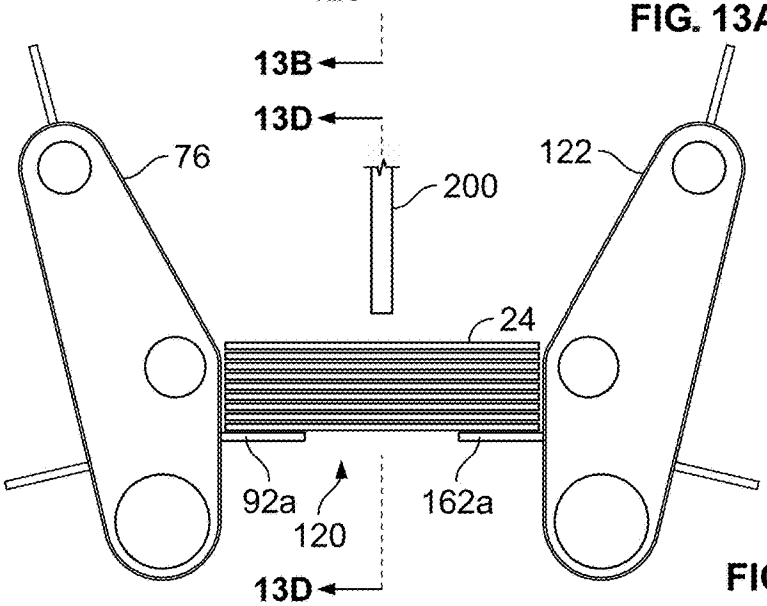
FIG. 13C is an elevational schematic view similar to FIG. 13A but with more items loaded on fins of the belts.

FIG. 13C is a view similar to FIG. 13A except that it shows nine items 24 in the stack of items on the fins 92*a* and 162*a*. As described in more detail below, the fins 92*a* and 162*a* are shown as being positioned lower in FIG. 13C than the position shown in FIG. 13A. The belts 76 and 122 rotate in the directions shown in FIG. 11 as items 24 are fed on the belts 76 and 122 so that the top of the stack of items 24 remains in substantially the same position. FIG. 13D shows an additional item 204 being fed on top of the stack of nine items 24 that are shown in FIG. 13C. As can be seen by comparing FIGS. 13B and 13D, the top of the stack of items 24 in FIG. 13D is approximately the same vertical distance from the bottom of the guide bar 200 as the top of the stack of items 24 in FIG. 13B. By keeping the distance between the top of the stack of items 24 and the bottom of the guide bar 200 approximately the same as items are fed between the belts 76 and 122, each item fed between the belts 76 and 122 engages the bottom of the guide bar 200 and the top of the stack of items 24 in a similar manner to assist in guiding the items into alignment on the stack of items.

Figure 14A:
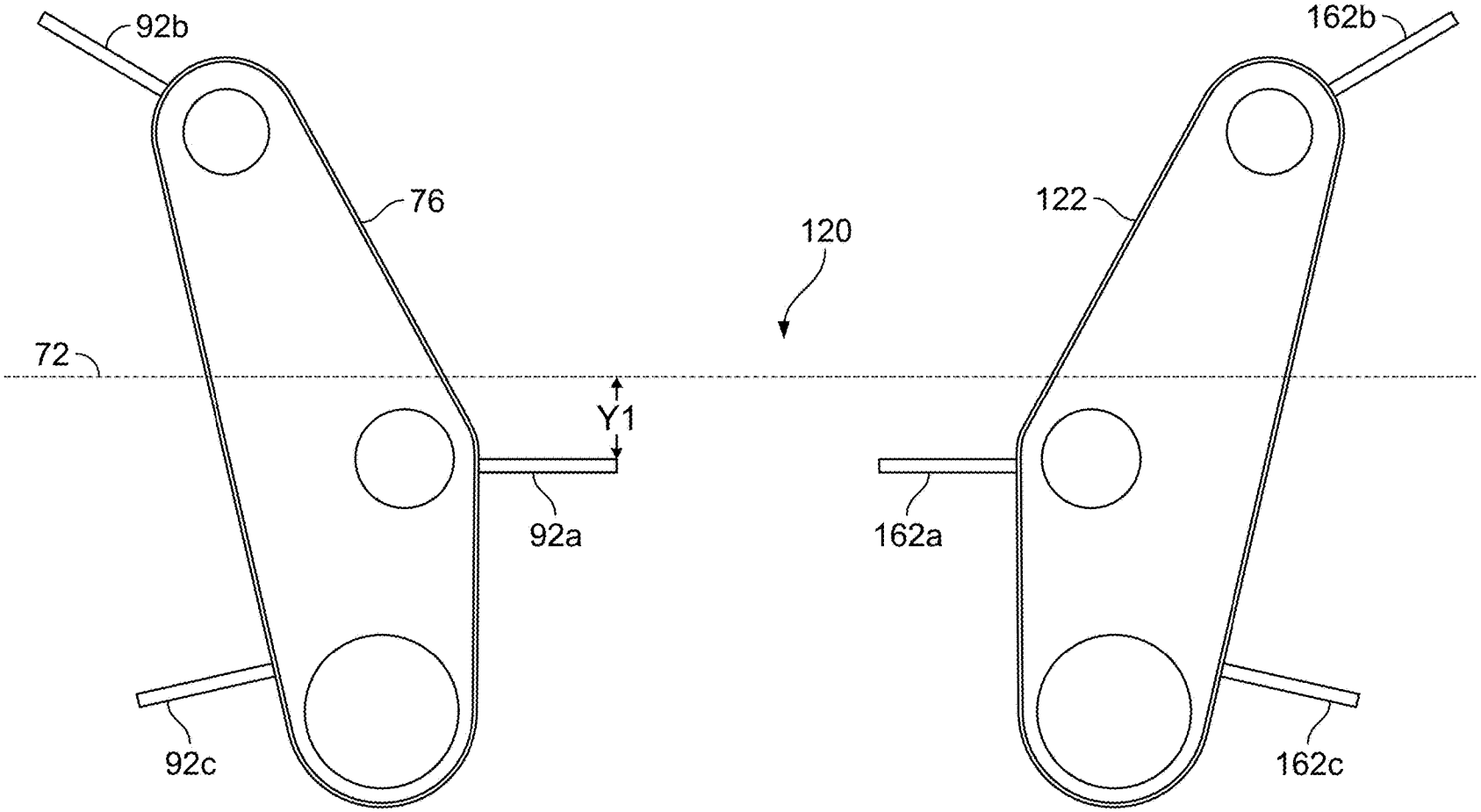
FIG. 14A is an elevational schematic view of the belts of the dump gate system shown in FIG. 1 with the fins in an initial loading position.
Figure 14B:
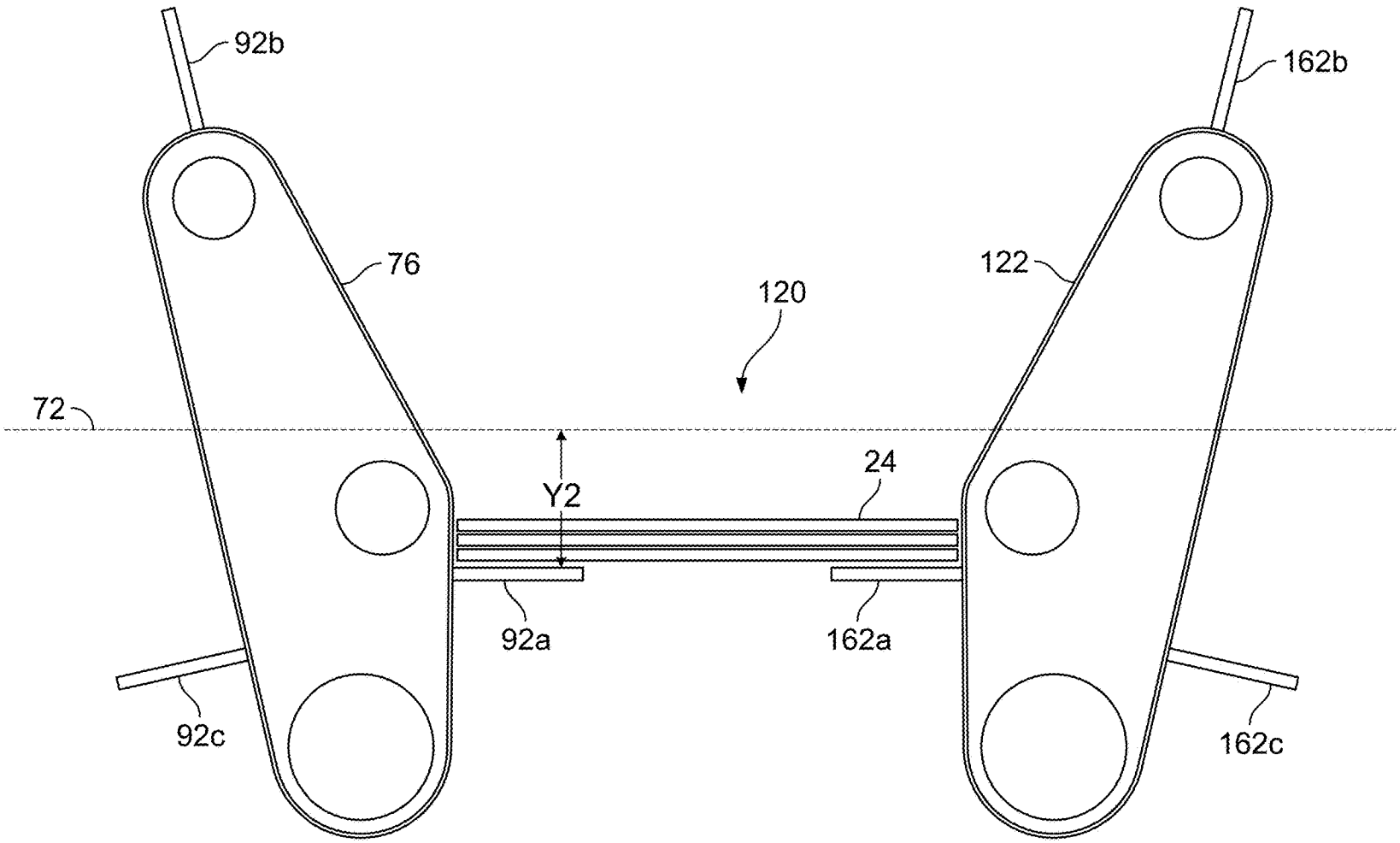
FIG. 14B is an elevational schematic view similar to FIG. 14A showing the fins in a final loading position.
Figure 14C:
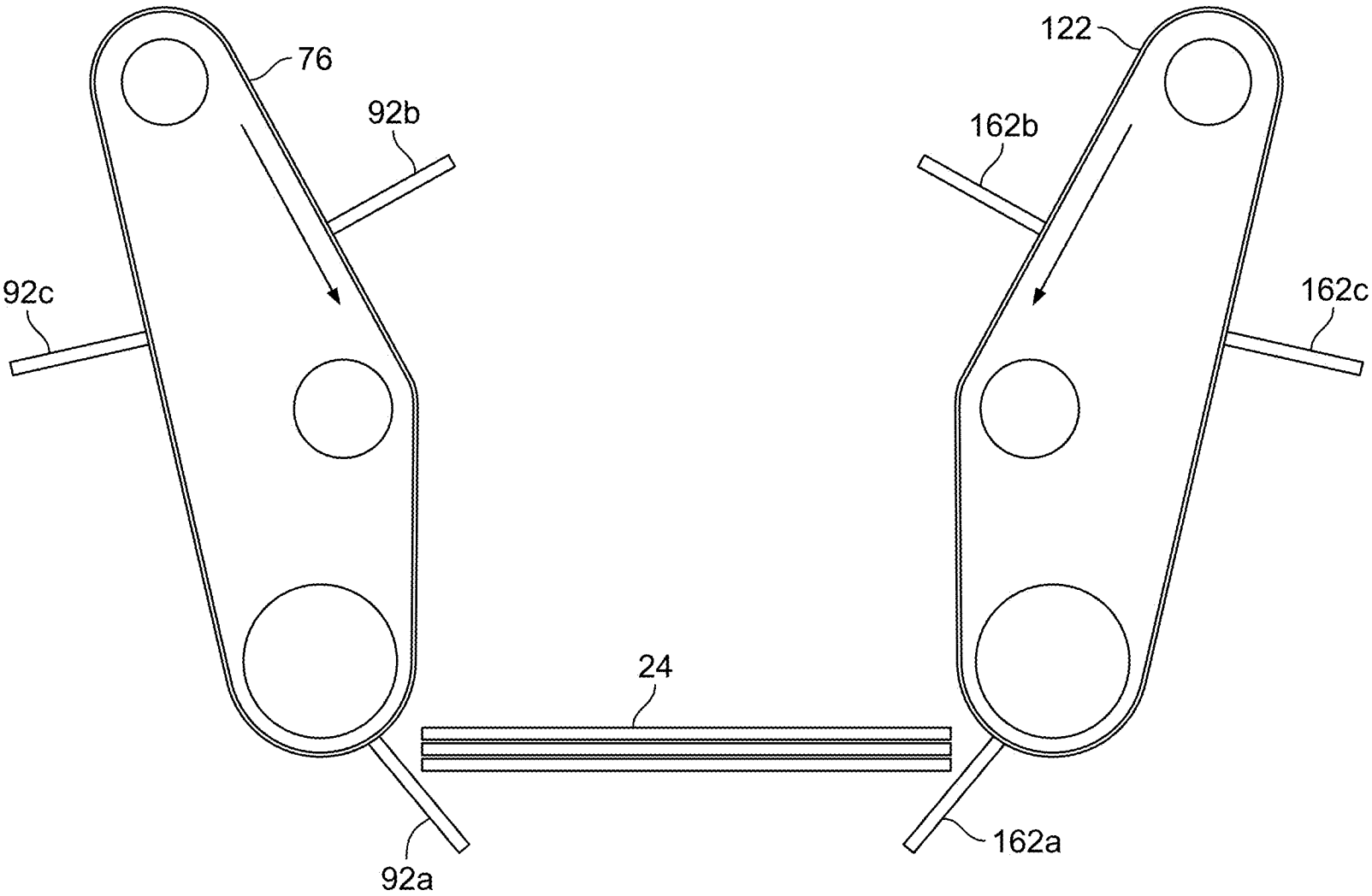
FIG. 14C is an elevational schematic view similar to FIG. 14A showing the fins moving to a dump position.

FIGS. 14A-C sequentially show three exemplary positions of the belts 76 and 122 in operation as three items 24 are loaded on the fins 92*a* and 162*a*. FIG. 14A shows the fins 92*a* and 162*a* in an initial loading position. In this position, the fins 92*a* and 162*a* are at approximately the same height as each other and are spaced apart from each other across the gap 120. There is a vertical distance Y1 between the top of the fins 92*a* and 162*a* and the feeding platform 72 of the feeder 22. FIG. 14B shows three items 24 supported by the fins 92*a* and 162*a* in the gap 120. The distance Y2 between the top of the fins 92*a* and 162*a* and the feeding platform 72 is greater than the distance Y1 shown in FIG. 14A. The difference between the distances Y2 and Y1 is approximately the same as the height of the stack of items 24 on the fins 92*a* and 162*a* such that the distance between the top of the stack of items 24 and the feeding platform 72 is approximately the same as the distance Y1 shown in FIG. 14A. As the items 24 are fed on the fins 92*a* and 162*a*, the belts 76 and 122 rotate to constantly move the fins 92*a* and 162*a* downward from the initial loading position shown in FIG. 14A to the final loading position shown in FIG. 14B. Rotation of the belts 76 and 122 as the items 24 are fed on the fins 92*a* and 162*a* maintains the vertical distance between the topmost item 24 on the fins 92*a* and 162*a* and the feeding platform 72 at approximately the same as the distance Y1 shown in FIG. 14A.

FIG. 14C shows the belts 76 and 122 as they move from the position shown in FIG. 14B to a dump position. The conveyor system 28 sends a dump signal to the feeder 22 when a box or pocket is in place beneath the belts 76 and 122. The feeder 22 relays the dump signal to the drive system 78 of each roller assembly 14 and 16. When the drive system 78 receives the dump signal from the feeder 22, the drive system 78 rotates the belts 76 and 122 from the position shown in FIG. 14B to the position shown in FIG. 14C and continues to rotate the belts 76 and 122 until the fins 92*a* and 162*a* are in a dump position corresponding to the position of the fins 92*c* and 162*c* shown in FIG. 14A. When the fins 92*a* and 162*a* are in the dump position, the fins 92*b* and 162*b* are in the same initial loading position as the fins 92*a* and 162*a* shown in FIG. 14A. As shown in FIG. 14C, the items 24 are beginning to disengage from the fins 92*a* and 162*a*. As the belts 76 and 122 continue to rotate, the items 24 will completely disengage from the fins 92*a* and 162*a* and be dumped in a box 26 located on the conveyor system 28 (FIG. 2). The process may then start over again with the fins 92*b* and 162*b* being loaded with items as they move from the initial loading position to the final loading position. Because the fins 92*b* and 162*b* move to the initial loading position as the fins 92*a* and 162*a* move to the dump position, the feeding process can begin much more quickly in comparison to a conventional dump gate system that must delay feeding until the dump gates return to their loading position. When the fins 92*b* and 162*b* are moved to the dump position, the fins 92*c* and 162*c* move to the initial loading position, where they may be loaded with items. This process may operate continuously with each stack of items loaded on the fins being dropped into a separate box 26 on the conveyor system 28.

During operation, the feeder 22 (FIG. 2), conveyor system 28, and motor 94 (FIG. 7) of each roller assembly 14 and 16 may communicate with each other as follows. The feeder 22 may have a controller that is programmed to send a dump signal to the roller assemblies 14 and 16 after the feeder 22 has received a dump signal from the conveyor system 28, which indicates that a box or pocket is in place and ready to receive the items. For example, if it is desired to load each box 26 on the conveyor system 28 with ten items, the feeder 22 counts the number of items delivered to the roller assemblies 14 and 16. After feeding the ten items, the feeder 22 waits until it receives a dump signal from the conveyor system 28, which indicates that a box or pocket is in place and ready to receive the items. The feeder 22 relays the dump signal to the roller assemblies 14 and 16. The dump signal causes the motors 94 to advance the belts 76 and 122 from the position shown in FIG. 14B to the position shown in FIG. 14C and then to the position shown in FIG. 14A (except with fins 92*b* and 162*b* in the initial loading position), as described above. While the fins 92*b* and 162*b* are moving to the initial loading position, the feeder 22 delays a set period of time before it begins feeding items again. For example, the feeder 22 may be programmed to delay feeding for a set period of time corresponding to the amount of time it takes for the fins 92*b* and 162*b* to move to the initial loading position while the fins 92*a* and 162*a* are dumping items. Once the set amount of time has passed, the feeder 22 begins feeding items between the roller assemblies 14 and 16. As soon as the fins 92*b* and 162*b* move to the initial loading position, the motor 94 of each roller assembly 14 and 16 will start to rotate each belt 76 and 122 at a constant speed. This constant speed may correlate with the speed that the feeder 22 feeds items between the roller assemblies 14 and 16. For example, as described above, the belts 76 and 122 may rotate at a speed such that the topmost item on the stack of items supported by the fins is always approximately the same vertical distance from the feeding platform 72 (FIGS. 14A and B). Once the feeder 22 has fed the desired amount of items between the roller assemblies 14 and 16, the feeder 22 and the motor 94 of each roller assembly 14 and 16 will pause until a dump signal is received from the conveyor system 28, which indicates that a box or pocket is in place and ready to receive the items. When the feeder 22 receives the dump signal from the conveyor system 28, the feeder 22 relays the dump signal to the roller assemblies 14 and 16 as described above. The process may operate continuously in this manner and drop each set of items into a box 26 on the conveyor system 28. The conveyor system 28 can either have indexed motion or continuous motion. In either case, the conveyor system 28 has a controller that sends a dump signal to feeder 22 when the items should be dropped. The feeder 22 controls the dump gate system 10 to provide the items as demanded by the conveyor system 28.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A dump gate system comprising:

a first belt configured for rotation in a first direction;

a second belt configured for rotation in a second direction that is opposite the first direction, the second belt spaced apart from the first belt to present a gap between the first and second belts, wherein each of the first and second belts comprises a tapered section that extends from the top of the respective belt to a lower section of the respective belt, wherein the lower section of each of the belts extends from the tapered section of the respective belt to the bottom of the respective belt, wherein each of the belts tapers toward the other of the belts in the tapered section to gradually reduce the width of the gap from the top of each of the belts to the lower section, and wherein the lower section of the first belt is generally parallel to the lower section of the second belt; and first and second fins extending outward from the first and second belts, respectively, the first and second fins configured to support at least one item in the gap when the first and second fins are in a loading position, and the first and second fins configured to dump the at least one item when the first and second belts move the first and second fins, respectively, to a dump position.

2. The dump gate system of claim 1, wherein a plurality of fins extend outward from each of the first and second belts.

3. The dump gate system of claim 1, wherein the first and second fins are formed from a flexible material.

4. The dump gate system of claim 1, wherein the first belt is mounted on a first roller frame and the second belt is mounted on a second roller frame, wherein the first and second roller frames are movable with respect to each other to adjust the width of the gap.

5. The dump gate system of claim 4, wherein the first and second fins are configured to support a first item fed into the gap when the first and second fins are in an initial loading position; and further comprising a drive system configured to rotate the first and second belts to move the first and second fins from the initial loading position to a final loading position, and wherein the first and second fins are configured to support a plurality of additional items that are fed into the gap on top of the first item while the first and second fins move from the initial loading position to the final loading position.

6. The dump gate system of claim 1, further comprising a backstop positioned adjacent the first and second belts, the backstop configured to contact an edge of the item when the item is fed between the first and second belts.

7. The dump gate system of claim 1, further comprising a guide bar positioned in the gap, the guide bar configured to contact a top surface of the item when the item is fed between the first and second belts.

8. The dump gate system of claim 1, wherein the first and second fins are configured to support a first item fed into the gap when the first and second fins are in an initial loading position, and further comprising a drive system configured to rotate the first and second belts to move the first and second fins from the initial loading position to a final loading position, and wherein the first and second fins are configured to support a plurality of additional items that are fed into the gap on top of the first item while the first and second fins move from the initial loading position to the final loading position.

9. The dump gate system of claim 8, further comprising a feeding platform from which the first item and plurality of additional items are fed into the gap.

10. The dump gate system of claim 9, wherein there is a predetermined vertical distance from the top of the first and second fins to the feeding platform when the first and second fins are in the initial loading position.

11. The dump gate system of claim 10, wherein as the first and second fins move from the initial loading position to the final loading position, the vertical distance from the topmost one of the first item and the plurality of additional items that are supported by the first and second fins is substantially the same as the predetermined vertical distance.

12. The dump gate system of claim 8, wherein the drive system is configured to rotate the first and second belts to move the first and second fins from the final loading position to the dump position, and wherein the first and second fins are configured to dump the first item and the plurality of additional items when the first and second fins are in the dump position.

13. The dump gate system of claim 12, wherein the drive system moves the first and second fins from the final loading position to the dump position in response to receiving a dump signal from a conveyor system.

14. The dump gate system of claim 13, further comprising third and fourth fins extending outward from the first and second belts, respectively, wherein the third and fourth fins move to the initial loading position as the first and second fins move to the dump position.

15. A method of operating a dump gate system having first and second belts spaced apart from each other to present a gap between the belts, and first and second fins extending outward from the first and second belts, respectively, the method comprising:

feeding a plurality of items into the gap so that the items are supported by the first and second fins while the first and second belts rotate in opposite directions to move the first and second fins from an initial loading position to a final loading position; and dumping the plurality of items from the first and second fins by rotating the first and second belts to move the first and second fins from the final loading position to a dump position, wherein each of the first and second belts comprises a tapered section that extends from the top of the respective belt to a lower section of the respective belt, wherein the lower section of each of the belts extends from the tapered section of the respective belt to the bottom of the respective belt, wherein each of the belts tapers toward the other of the belts in the tapered section to gradually reduce the width of the gap from the top of each of the belts to the lower section, and wherein the lower section of the first belt is generally parallel to the lower section of the second belt.

16. The method of claim 15, wherein the plurality of items are fed from a feeding platform, and wherein there is a predetermined vertical distance from the top of the first and second fins to the feeding platform when the first and second fins are in the initial loading position.

17. The method of claim 16, wherein as the first and second fins move from the initial loading position to the final loading position, the vertical distance from the topmost one of the plurality of items that are supported by the first and second fins is substantially the same as the predetermined vertical distance.

18. The method of claim 15, further comprising sending a dump signal from a conveyor system to a drive system before dumping the plurality of items.

19. The method of claim 15, further comprising third and fourth fins extending outward from the first and second belts, respectively, wherein the third and fourth fins move to the initial loading position as the first and second fins move to the dump position.

* * * * *